US008299976B2

(12) United States Patent
Lenzi et al.

(10) Patent No.: US 8,299,976 B2
(45) Date of Patent: Oct. 30, 2012

(54) OMNI-DIRECTIONAL ANTENNA IN AN HOURGLASS-SHAPED VASE HOUSING

(75) Inventors: Louis E. Lenzi, Carmel, IN (US); Henry D. Caskey, Cicero, IN (US); Prapan Paul Tinaphong, Westfield, IN (US); David A. Benedetti, Carmel, IN (US); Chung Hua Hung, Kaohsiung Hsien (TW); Hong Yin, Carmel, IN (US)

(73) Assignee: Audiovox Corporation, Hauppauge, NY (US)

( * ) Notice: Subject to any disclaimer, the term of this patent is extended or adjusted under 35 U.S.C. 154(b) by 229 days.

(21) Appl. No.: 12/655,771

(22) Filed: Jan. 7, 2010

(65) Prior Publication Data

US 2010/0289716 A1 Nov. 18, 2010

Related U.S. Application Data

(60) Provisional application No. 61/204,448, filed on Jan. 7, 2009.

(51) Int. Cl.
*H01Q 9/16* (2006.01)

(52) U.S. Cl. ..... 343/793

(58) Field of Classification Search ..... 343/793, 343/895, 770, 702, 915
See application file for complete search history.

(56) References Cited

U.S. PATENT DOCUMENTS

| | | | | |
|---|---|---|---|---|
| 4,980,807 | A * | 12/1990 | Von Kohorn | 362/122 |
| 6,188,364 | B1 | 2/2001 | Scordilis | 343/702 |
| 6,344,835 | B1 | 2/2002 | Allen et al. | 343/915 |
| 6,518,931 | B1 * | 2/2003 | Sievenpiper | 343/770 |
| 6,922,179 | B2 * | 7/2005 | McCollum | 343/895 |

OTHER PUBLICATIONS

Notification of Transmittal of the International Search Report and the Written Opinion of the International Searching Authority, or the Declaration; International Search Report; and the Written Opinion of the International Searching Authority.

* cited by examiner

*Primary Examiner* — Huedung Mancuso
(74) *Attorney, Agent, or Firm* — Gerald T. Bodner

(57) ABSTRACT

An antenna structure for receiving digital television broadcast signals includes a vase antenna housing having a generally hourglass shape with conically-shaped upper and lower segments joined together to define a narrower diameter middle portion. The antenna structure further includes a signal receiving antenna etched on the inner surface of the vase antenna housing. The signal receiving antenna conforms to the shape of the vase antenna housing and thereby exhibits an arcuate, partial hourglass shape. The signal receiving antenna may be a cloverleaf antenna or a spiral antenna.

9 Claims, 41 Drawing Sheets

Gain @ Vertical (dBd) :

| FREQ.(MHz) | 179 | 191 | 203 | 215 | 475 | 511 | 547 |
|---|---|---|---|---|---|---|---|
| Large Vase Ant. | -8.93 | -6.2 | -5.47 | -6.11 | -8.58 | -11.56 | -7.89 |

| FREQ.(MHz) | 583 | 619 | 655 | 691 | 727 | 763 | 805 |
|---|---|---|---|---|---|---|---|
| Large Vase Ant. | -8.75 | -7.46 | -6.32 | -7.24 | -5.92 | -7.84 | -10.01 |

Figure 11

805 MHz

763 MHz

Gain @ Vertical (dBd) :

| FREQ.(MHz) | 179 | 191 | 203 | 215 | 475 | 511 | 547 |
|---|---|---|---|---|---|---|---|
| Small Vase Ant. | -26.87 | -22.14 | -21.56 | -23.85 | -10.48 | -10.21 | -8.55 |

| FREQ.(MHz) | 583 | 619 | 655 | 691 | 727 | 763 | 805 |
|---|---|---|---|---|---|---|---|
| Small Vase Ant. | -11.33 | -10.52 | -7.6 | -7.8 | -8.95 | -7.15 | -6.94 |

Figure 15

805 MHz

763 MHz

Gain @ Vertical (dBd) :

| FREQ.(MHz) | 179 | 191 | 203 | 215 | 475 | 511 | 547 |
|---|---|---|---|---|---|---|---|
| Small Vase Ant. | -26.54 | -18.53 | -19.3 | -22.35 | -5.47 | -10.03 | -6.8 |

| FREQ.(MHz) | 583 | 619 | 655 | 691 | 727 | 763 | 805 |
|---|---|---|---|---|---|---|---|
| Small Vase Ant. | -8.43 | -10.48 | -8.96 | -8.86 | -9.5 | -7.28 | -4.34 |

Figure 19

805 MHz

763 MHz

FIG. 29

1GAIN @ Vertical :

1.1GAIN @ VHF Band ( dBd ):

| FREQ.(MHz) | 57 | 63 | 69 | 79 | 85 | 177 | 183 | 189 | 195 | 201 | 207 | 213 |
|---|---|---|---|---|---|---|---|---|---|---|---|---|
| Vase Version A | -8.40 | -16.72 | -19.90 | -16.99 | -21.96 | -9.09 | -13.30 | -11.84 | -7.63 | -6.25 | -5.14 | -5.87 |

1.2 GAIN @ UHF Band ( dBd ):

| FREQ.(MHz) | 473 | 503 | 533 | 563 | 593 | 623 | 653 | 683 | 713 | 749 |
|---|---|---|---|---|---|---|---|---|---|---|
| Vase Version A | -7.91 | -2.97 | -1.92 | -1.76 | -2.81 | -1.69 | -3.26 | -7.95 | -6.74 | -6.06 |

FIG. 30

2 OMMI-Direction angle @ Vertical :

2.1 VHF Band :

| FREQ.(MHz) | 177 | 183 | 189 | 195 | 201 | 207 | 213 |
|---|---|---|---|---|---|---|---|
| Vase Version A | 225 | 240 | 195 | 210 | 240 | 195 | 180 |

2.2 UHF Band

| FREQ.(MHz) | 473 | 503 | 533 | 563 | 593 | 623 | 653 | 683 | 723 | 749 |
|---|---|---|---|---|---|---|---|---|---|---|
| Vase Version A | 315 | 315 | 285 | 195 | 210 | 240 | 330 | 315 | 330 | 270 |

FIG. 36

1 GAIN @ Vertical :

1.1 GAIN @ VHF Band ( dBd ):

| FREQ.(MHz) | 57 | 63 | 69 | 79 | 85 | 177 | 183 | 189 | 195 | 201 | 207 | 213 |
|---|---|---|---|---|---|---|---|---|---|---|---|---|
| Vase Version B | -16.14 | -16.41 | -21.45 | -6.14 | -17.78 | -2.06 | -4.30 | -6.76 | -6.83 | -6.89 | -5.39 | -4.38 |

1.2、GAIN @ UHF Band ( dBd ):

| FREQ.(MHz) | 473 | 503 | 533 | 563 | 593 | 623 | 653 | 683 | 713 | 749 |
|---|---|---|---|---|---|---|---|---|---|---|
| Vase Version B | -5.58 | -8.32 | -6.23 | -3.48 | -2.03 | -9.59 | -5.33 | -5.91 | -4.41 | -4.54 |

FIG. 37

2 OMMI-Direction angle @ Vertical :

2.1 VHF Band :

| FREQ.(MHz) | 177 | 183 | 189 | 195 | 201 | 207 | 213 |
|---|---|---|---|---|---|---|---|
| Vase Version B | 180 ° | 285 ° | 360 ° | 300 ° | 285 ° | 285 ° | 300 ° |

2.2 UHF Band

| FREQ.(MHz) | 473 | 503 | 533 | 563 | 593 | 623 | 653 | 683 | 723 | 749 |
|---|---|---|---|---|---|---|---|---|---|---|
| Vase Version B | 195 ° | 360 ° | 300 ° | 270 ° | 285 ° | 330 ° | 315 ° | 300 ° | 300 ° | 330 ° |

OMNI-DIRECTIONAL ANTENNA IN AN HOURGLASS-SHAPED VASE HOUSING

CROSS-REFERENCE TO RELATED APPLICATION

This application is related to U.S. Provisional Application Ser. No. 61/204,448, filed on Jan. 7, 2009, and entitled "Omni-Directional Antenna In An Hourglass-Shaped Vase Housing", the disclosure of which is incorporated herein by reference. This application claims the benefit of priority under 35 U.S.C. 119 and/or 35 U.S.C. 120 to the aforementioned related provisional application.

BACKGROUND OF THE INVENTION

1. Field of the Invention

The present invention generally relates to antennas for receiving broadcast signals such as television signals, and more specifically relates to television antennas for receiving digitally formatted broadcast signals.

2. Description of the Prior Art

Conventional indoor TV antenna systems generally include two separate antennas for respective VHF and UHF reception. The antenna for receiving the VHF bands employs a pair of telescopic elements forming a dipole with each of the elements having a maximum length of from 4 to 6 feet (1.5 to 2.5 m). The two elements usually are mounted to permit the elements to be spread apart to increase or shorten the dipole length and those elements are commonly referred to as "rabbit ears." The indoor UHF antenna typically is a loop having a diameter of about 7½ inches (20 cm).

One problem associated with the conventional indoor antenna systems is that the physical dimension of the VHF dipole is undesirably long for the ordinary setting in a living room and that the length as well as the direction of the dipole elements may need to be adjusted depending upon the receiving channels. A second problem is that the performance of such conventional indoor VHF/UHF antennas changes in response to changes of the physical conditions around the antenna elements. For example, it is difficult for a user to make proper adjustment of the antennas since a human body coming into contact with an antenna changes the electromagnetic conditions associated with the antenna elements.

A third problem is that the conventional indoor antenna systems do not always provide a sufficient signal level for good reception.

A fourth problem associated with the "rabbit ears" antenna is that, while it is currently functional, it is far from being aesthetically attractive and its large size makes it difficult to conceal.

A fifth problem associated with the aforementioned antenna is that it is not well-suited for receiving digitally formatted, high definition, broadcast television signals.

NTSC (National Television Standards Committee) broadcast signals were adopted by the United States in 1941 as the standardized television broadcasting and video format which is currently in use. The NTSC signals are analog signals. However, the NTSC analog format was phased out on Jun. 12, 2009, and all TV broadcasting signals have been changed to an ATSC (Advanced Television Systems Committee) digital format. The ATSC standard for digital television has been adopted by the United States and several other countries.

As a result, the television receiver antenna has become a critical element for the new digital TV reception system in order to receive all new digital TV channels which are mainly in the UHF (ultra high frequency) band, with some channels being in the upper VHF (very high frequency) band covering conventional TV channels 7 to 13. Without a good omnidirectional TV antenna, consumers will not be able to receive all of the digital ATSC signals with the broadcast format change that has come about. Most conventional indoor or outdoor antennas only receive the signals when the antenna is pointed in the direction of the TV broadcasting station; otherwise, the converter box or ATSC television only show a blank screen on the television. With the analog NTSC broadcast signals, consumers still were able to see some pictures or snowy images when the antenna was not pointed into the right direction, and consumers could still rotate the antenna to the right direction by watching the picture quality change the display on the television. Digital televisions that receive ATSC signals either display a picture or a blank or dark screen, and thus provide no indication that alert consumers that they should rotate the antenna to achieve better channel reception in the same area.

OBJECTS AND SUMMARY OF THE INVENTION

It is an object of the present invention to provide an antenna for the reception of digitally formatted, broadcast television signals.

It is another object of the present invention to provide an indoor television antenna which is omni-directional and, therefore, needs no adjustment for receiving a broad range of broadcast television signals.

It is a further object of the present invention to provide an indoor antenna for use with television receivers which receives both analog and digital television signals.

It is another object of the present invention to provide a reception antenna for television receivers, which antenna includes an attractive, hourglass-shaped vase housing in which the antenna elements are situated.

In accordance with one form of the present invention, an antenna, which is preferably for indoor use and constructed especially for receiving digitally formatted, broadcast television signals, exhibits good omnidirectionality and relatively high gain for good television signal reception to minimize or eliminate the need for the user to adjust the position of the antenna. In one form, the antenna is situated within an attractive, hourglass-shaped vase housing having generally conically-shaped upper and lower segments joined together to define a centered or off-centered relatively narrower diameter middle portion. The opposite top and bottom end portions of the housing defined respectively by the larger ends of the upper and lower segments thus are formed with a relatively larger diameter than that of the middle portion. The housing provides a form for supporting the antenna and otherwise plays no part in the functionality of the antenna, but rather provides an overall pleasing appearance for housing the antenna so that the user would be more inclined to display the housing in proximity to his television.

The antenna situated within the housing may be configured in the form of a pair of bowtie antennas, the bowtie antennas being disposed transversely or angularly to each other, with the center of one bowtie antenna overlapping or in proximity to that of the other bowtie antenna, and with their centers preferably arranged in alignment with the narrower middle portion of the hourglass-shaped vase housing. The bowtie-pair embodiment defines generally a cloverleaf antenna preferably centrally aligned with the narrower middle portion of the housing. Alternatively, the antenna may be a spiral antenna situated within the housing and whose center is aligned with the narrower middle portion of the housing.

These and other objects, features and advantages of the present invention will be apparent from the following detailed description of illustrative embodiments thereof, which is to be read in connection with the accompanying drawings.

BRIEF DESCRIPTION OF THE DRAWINGS

FIG. 11 is a chart showing the gain at vertical (in dBd) measured at certain frequencies (in MHz) for a spiral antenna, such as shown in FIG. 6, situated within the hourglass-shaped vase housing, as shown in FIG. 7, and formed in accordance with the present invention.

FIG. 15 is a chart showing the gain at vertical (in dBd) measured at certain frequencies (in MHz) for a cloverleaf antenna formed of two bowtie antennas, such as shown in FIG. 9, situated within the hourglass-shaped vase housing, as shown in FIG. 10, and formed in accordance with the present invention.

FIG. 19 is a chart showing the gain at vertical (in dBd) measured at certain frequencies (in MHz) for a cloverleaf antenna formed of two bowtie antennas, such as shown in FIG. 9, situated within the hourglass-shaped vase housing, as shown in FIG. 10, which in this situation is painted on the outer surface thereof, and formed in accordance with the present invention.

FIG. 29 is a chart showing the gain at vertical (in dBd) measured at certain frequencies (in MHz) for the signal receiving antenna shown in FIGS. 27 and 28, situated within the hourglass-shaped vase antenna housing, as shown in FIGS. 23-26, and formed in accordance with the present invention.

FIG. 30 is a chart showing the extent of omnidirectionality (omni-direction angle) (in degrees) at vertical measured at certain frequencies (in MHz) at a 3 dB point for the signal receiving antenna shown in FIGS. 27 and 28, situated within the hourglass-shaped vase antenna housing, as shown in FIGS. 23-26, and formed in accordance with the present invention.

FIG. 36 is a chart showing the gain at vertical (in dBd) measured at certain frequencies (in MHz) for the signal receiving antenna shown in FIGS. 34 and 35, situated within the hourglass-shaped vase antenna housing, as shown in FIGS. 23-26, and formed in accordance with the present invention.

FIG. 37 is a chart showing the extent of omnidirectionality (omni-direction angle) (in degrees) at vertical measured at certain frequencies (in MHz) at a 3 dB point for the signal receiving antenna shown in FIGS. 34 and 35, situated within the hourglass-shaped vase antenna housing, as shown in FIGS. 23-26, and formed in accordance with the present invention.

DETAILED DESCRIPTION OF THE PREFERRED EMBODIMENTS

Figure 2:
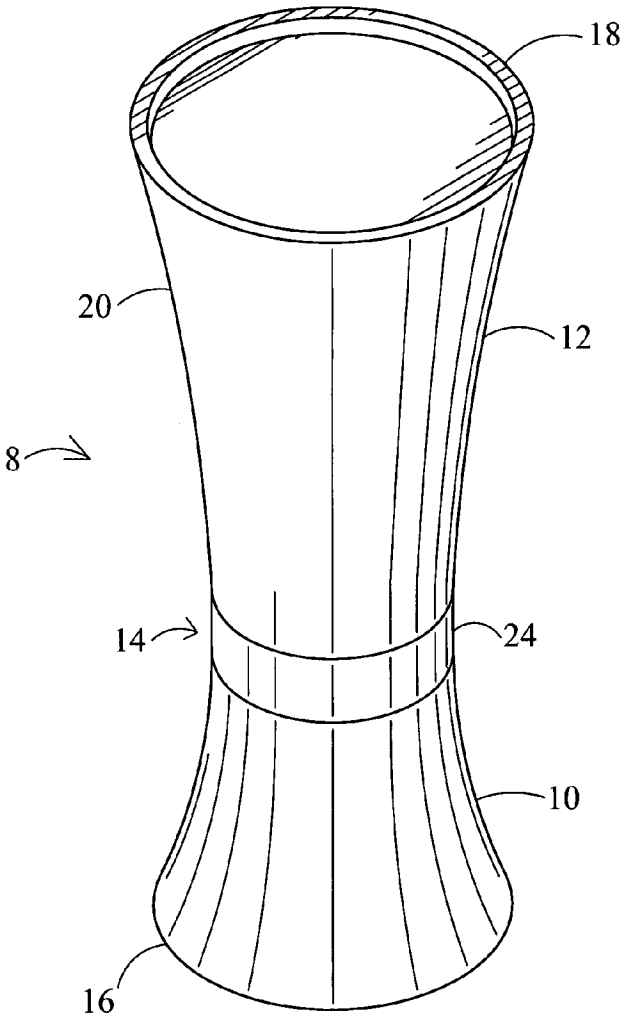
FIGS. 1-5 are various views (top isometric, bottom isometric, side, top and bottom, respectively) of an hourglass-shaped vase antenna housing in which the antenna of the present invention is situated.
Figure 1:
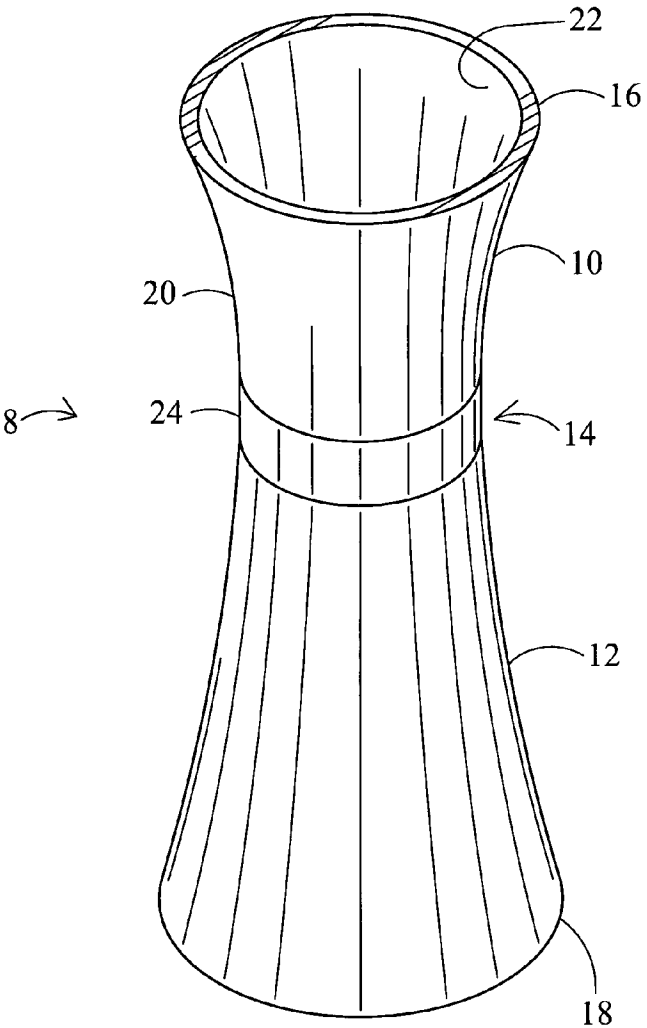
Figure 4:
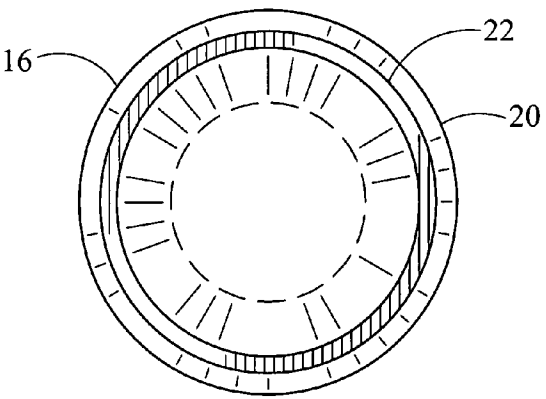
Figure 5:
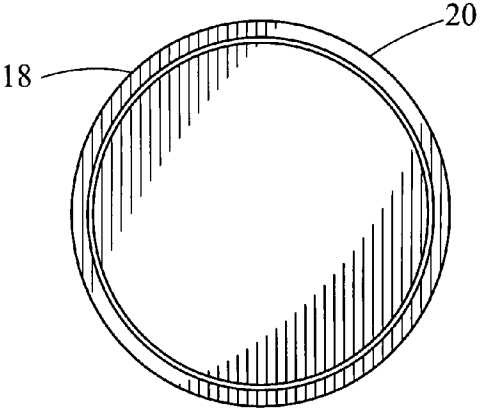
Figure 3:
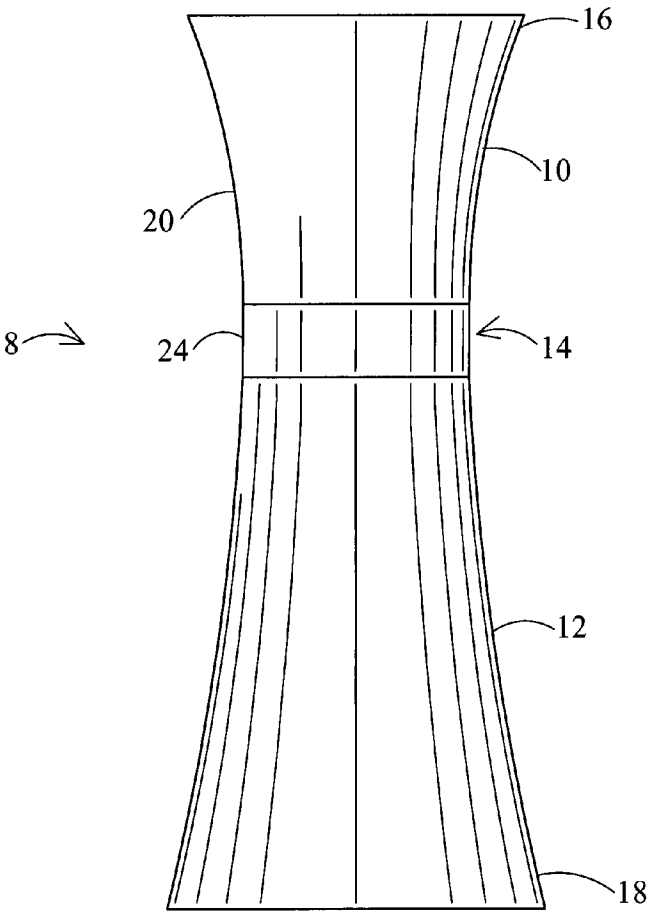

Referring initially to FIGS. 1-10 of the drawings, it will be seen that an omni-directional antenna 2 in the form of a spiral antenna 3, or a cloverleaf antenna 4 formed of two bowtie antennas 6, constructed in accordance with the present invention, is situated within a generally hourglass-shaped vase housing 8. The hourglass-shaped vase housing 8 includes generally conically-shaped upper and lower segments 10, 12 which are joined together (or integrally formed) to define a centered or off-centered (in height) relatively narrower diameter middle portion 14 situated between relatively larger diameter top end portion 16 and bottom end portion 18, each portion of the housing 8 preferably defining an interior cavity. The housing 8 plays no part in the functionality of the antenna 2 (except to provide support for the antenna), but rather provides an overall pleasing appearance for housing the antenna 2 so that the user will be more inclined to display the antenna structure in proximity to his television. The housing 8 may be formed from a glass, plastic or ceramic material, and includes at least one of an outer surface 20 and an opposite inner surface 22, the antenna 2 being preferably situated on at least one of the outer and inner surfaces 20, 22.

The antenna 2 of the present invention is designed to exhibit good omnidirectionality and relatively high gain for good television signal reception, especially for digitally formatted television signals, and to minimize or eliminate the need for the user to adjust the position of the antenna structure (i.e., the housing 8 and the antenna 2 mounted thereon). Preferably, the antenna of the present invention, along with the aesthetically pleasing hourglass-shaped housing 8, is used as an indoor television reception antenna, although it is envisioned to be within the scope of the present invention to use the antenna 2 and housing 8 as an outdoor antenna.

In one form of the present invention, the antenna 2 situated within the hourglass-shaped housing may be formed from a flexible copper or aluminum sheet or substrate which is adhered to the inside surface 22 of the hourglass-shaped vase housing 8. Alternatively, the antenna 2 may be painted on or etched into the inside surface 22 of the hourglass-shaped housing 8 using a metallic paint or the like having an aluminum base, silver base or copper base, or other metallic base or material which are conducive to good television signal receptivity.

Figure 8:
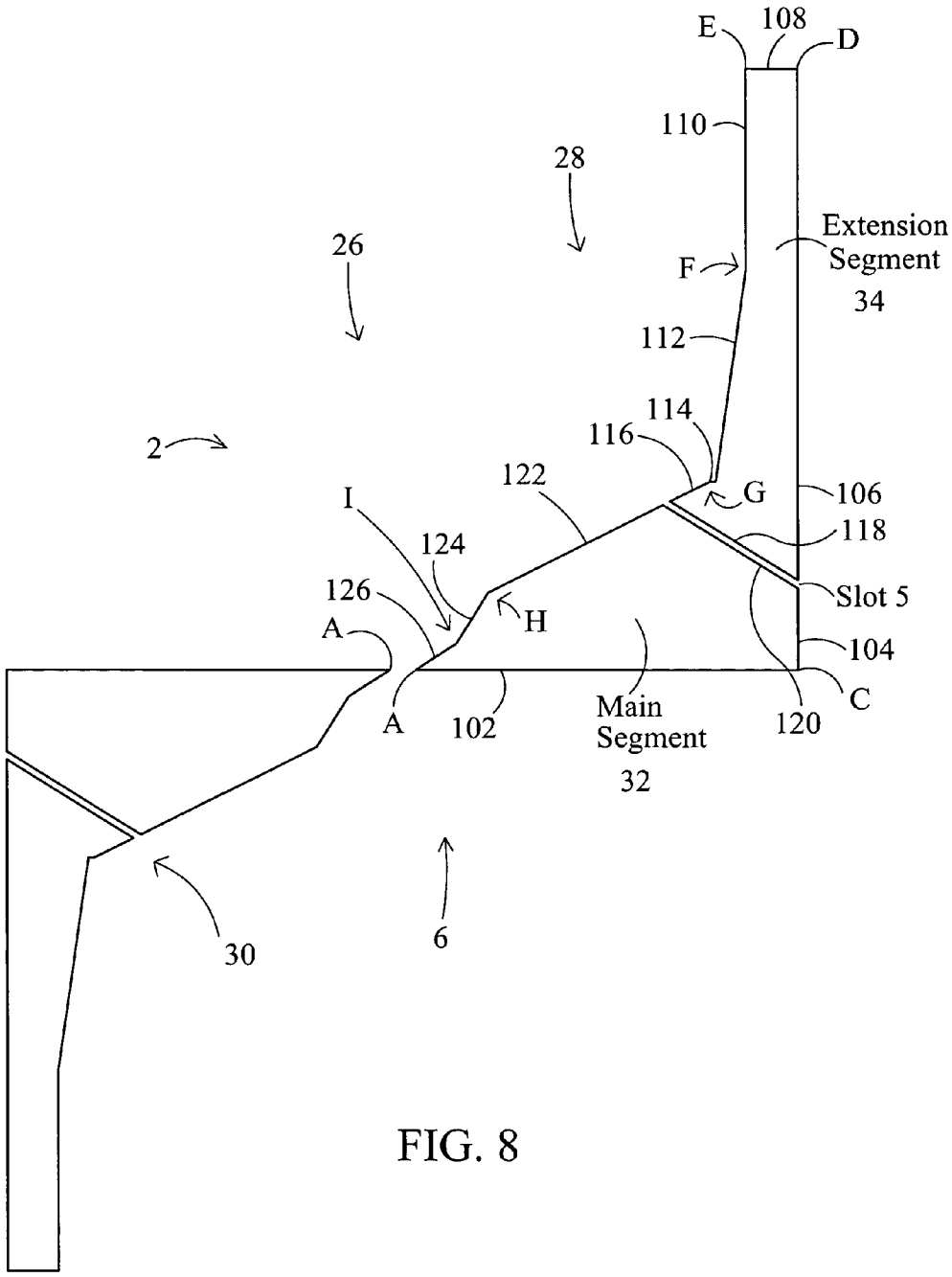
FIG. 8 is a top plan view of one of two similarly-shaped bowtie antennas which are combined to define a first form of a cloverleaf antenna of the present invention prior to it being situated within the housing.
Figure 9:
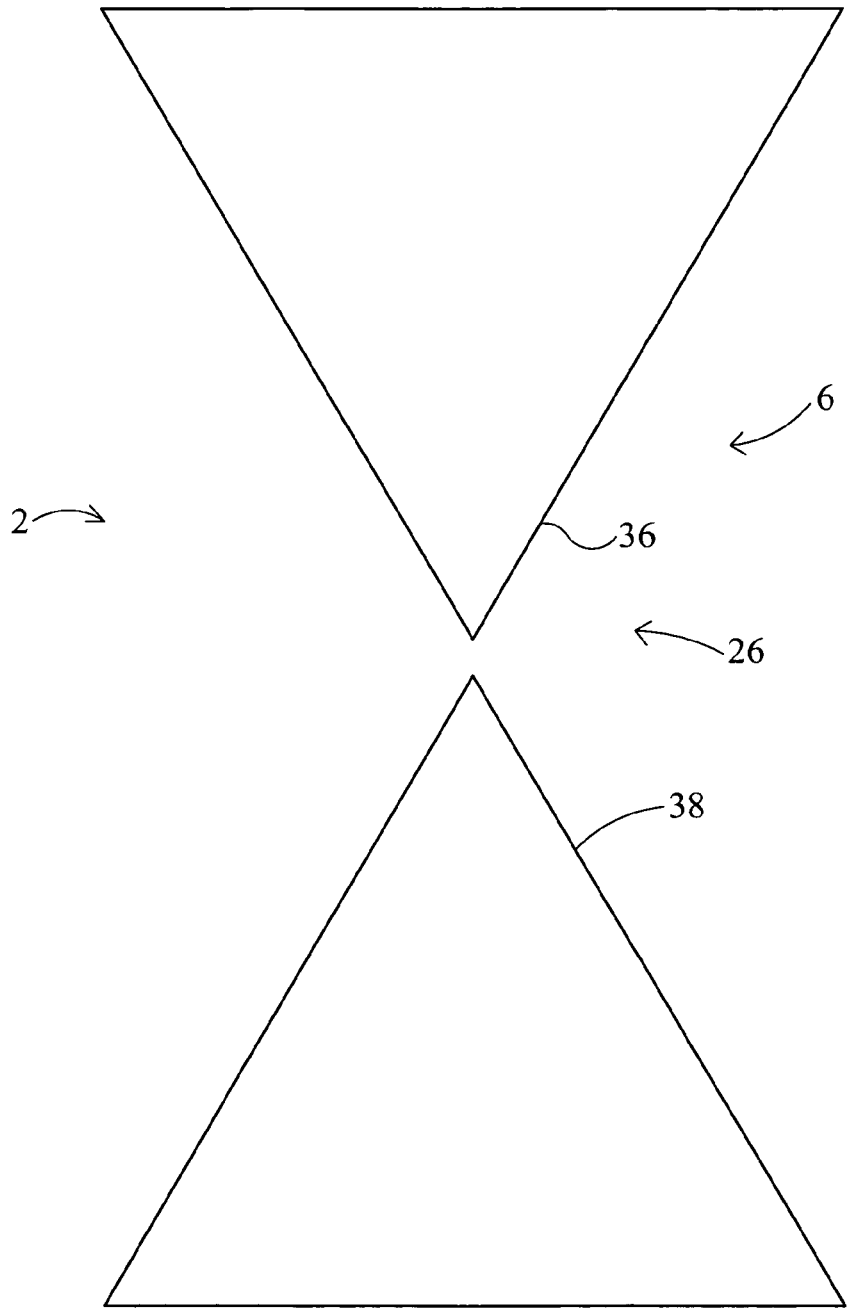
FIG. 9 is a top plan view of one of two similarly-shaped bowtie antennas which are combined to define a second form of a cloverleaf antenna of the present invention prior to it being situated within the housing.

In one form of the present invention, the antenna 2 may be formed from a pair of bowtie antennas 26, each bowtie antenna 26 preferably having the configuration shown in FIG. 8 or FIG. 9. The bowtie antennas 26 are preferably disposed transversely or angularly to each other, with the center of one bowtie antenna 26 overlapping or being in proximity to that of the other bowtie antenna 26, and with their centers preferably arranged at the narrower middle portion 14 of the hourglass-shaped vase housing 8. Thus, one "bow" portion or segment 28 of each bowtie antenna 26 is disposed above the narrower middle portion 14 of the hourglass-shaped vase housing 8 and situated on the inner surface 22 (or outer surface 20) of the upper conically-shaped segment 10 of the housing 8, while the opposite "bow" portion or segment 30 of the two bowtie antennas 26 are situated below the narrower middle portion 14 of the hourglass-shaped vase housing 8 on the inner surface 22 (or outer surface 20) of the lower conically-shaped segment 12 of the housing. Together, the bowtie antennas 26 define a cloverleaf antenna 4 which is situated within or on the outer surface of the hourglass-shaped vase housing 8. The center of the cloverleaf antenna arrangement 4 is disposed in alignment with the narrower middle portion 14 of the hourglass-shaped vase housing 8.

In the embodiment shown in FIG. 8 of the drawings, each "bow" portion 28, 30 of each bowtie antenna 26 is preferably solid and has the same dimensions and shape as its corresponding opposite "bow" portion 28, 30. Furthermore, each "bow" portion 28, 30 includes a main segment 32 and an extension segment 34 separated from the main segment 32 by a slot S and capacitively or inductively coupled to the main segment 32 by the relatively narrow width of the slot S. More specifically, the slot S is preferably about 1.5 millimeters in width separating the main segment 32 from the extension segment 34 of each "bow" portion 28, 30. Alternatively, an inductor (or capacitor) may be used to couple the extension segment 34 to the main segment 32 of the "bow" portion 28, 30, having opposite leads electrically connected to the main segment 32 and the extension segment 34, the inductor (or capacitor) being disposed across the slot S.

Each "bow" portion 28, 30 of each bowtie antenna 26 has been tuned to provide omnidirectionality and wide bandwidth to the overall configuration of the cloverleaf antenna 4 defined by the transversely disposed bowtie antennas 26. Accordingly, each of the extension segment 34 and the main segment 32 of each "bow" portion 28, 30 has specific dimensions to provide wide bandwidth characteristics and omnidirectionality.

More specifically, with respect to the embodiment shown in FIG. 8, each "bow" portion 28, 30 preferably has the following dimensions and structure: a first outer peripheral edge 102 extending from the apex A of the "bow" portion 28, 30 situated at the center of the bowtie antenna 26 to a corner C and having a length of about 8 millimeters; a second outer peripheral edge 104 extending from the corner C of the first outer peripheral edge 102 and disposed at a right angle thereto, and extending to the edge of the slot S, the first outer peripheral edge 102 and the second outer peripheral edge 104 defining the corner C of the main segment 32 of the "bow" portion 28, 30 and having a length of about 1.7 millimeters; one end of the elongated, linear slot S, the angled slot end having a width of about 2 millimeters; a third outer peripheral edge 106 forming the outer side of the extension segment 34, extending from the opposite side of the slot S on the same axial end thereof to the end corner D of the extension segment 34 and having a length of about 10.8 millimeters; a fourth outer peripheral edge 108 forming the far end of the extension segment 34 between right angled corner D and another right angled corner E and having a length of about 1.1 millimeters; a fifth outer peripheral edge 110 forming part of the extension segment 34, the fifth outer peripheral edge 110 being joined at a right angle to the fourth outer peripheral edge 108 at corner E and extending in a parallel direction to the third outer peripheral edge 106 back towards the slot S and having a length of about 4.15 millimeters; a sixth outer peripheral edge 112 defining an angled side of the extension segment 34 opposite to the third outer peripheral edge 106, the sixth outer peripheral edge 112 extending from an end of the fifth outer peripheral edge 110 and defining therewith an outer angle F of about 173 degrees, and extending a distance from the juncture of the fifth outer peripheral edge 110 and the sixth outer peripheral edge 112 a length of about 4.6 millimeters; a seventh outer peripheral edge 114 defining a small portion of a side of the extension segment 34 opposite the third outer peripheral edge 106, the seventh outer peripheral edge 114 extending in a direction parallel to the fourth outer peripheral edge 108 from the opposite end of the sixth outer peripheral edge 112 and having a length of about 0.1 millimeters; an eighth outer peripheral edge 116 defining a side of the extension segment 34, the eighth outer peripheral edge 116 extending from the outermost end of the seventh outer peripheral edge 114 a length of about 1 millimeter and forming with the seventh outer peripheral edge 114 an inner angle G of about 153 degrees, the length of the eighth outer peripheral edge 116 measured between the outermost end of the seventh outer peripheral edge 114 to the opposite axial end of the slot S being about 4.1 millimeters; the opposite angled axial end of the slot S having a width of about 2 millimeters; one side 118 of the slot S defining the innermost (closest to apex A) end of the extension segment 34 having a length of about 3.1 millimeters; the opposite side 120 of the slot S defining the most distal end of the main segment 32 of the "bow" portion 28, 30 having a length of about 3.3 millimeters; a ninth outer peripheral edge 122 defining a side of the main segment 32 of the "bow" portion 28, 30 extending from the opposite edge of the slot S on the same side and extending in a direction which is co-parallel with the eighth outer peripheral edge 116 and having a length of about 4.1 millimeters; a tenth outer peripheral edge 124 defining a portion of the main segment 32 of the "bow" portion 28, 30, which extends from the end of the ninth outer peripheral edge 122 a length of about 1.3 millimeters and forming an inner angle H with the ninth outer peripheral edge 122 of about 149 degrees; and an eleventh outer peripheral edge 126 extending from the end of the tenth outer peripheral edge 124 to the apex A of the "bow" portion 28, 30 and having a length of about 1 millimeter, and defining an outer angle I with the tenth outer peripheral edge 124 of about 153 degrees.

The second "bow" portion 30 of each bowtie antenna 26 has similar dimensions to those for the first "bow" portion 28 described previously. However, the two "bow" portions 28, 30 extend in opposite directions, as can be seen from FIG. 8. The apexes A of the "bow" portions 28, 30 face each other and are separated by a distance of about 0.5 millimeters. Thus, each "bow" portion 28, 30 of each bowtie antenna 26 includes a main segment 32 and an extension segment 34 such as described previously. It should be realized that the antenna of the present invention includes two such bowtie antennas 26, with their centers overlapping or in proximity to each other so that the two bowtie antennas 26 define a cloverleaf antenna 4. It should be further realized that the bowtie antennas 26 described above may be scaled to be larger or smaller than that described previously with dimensions that are proportional to those stated above.

Figure 10:
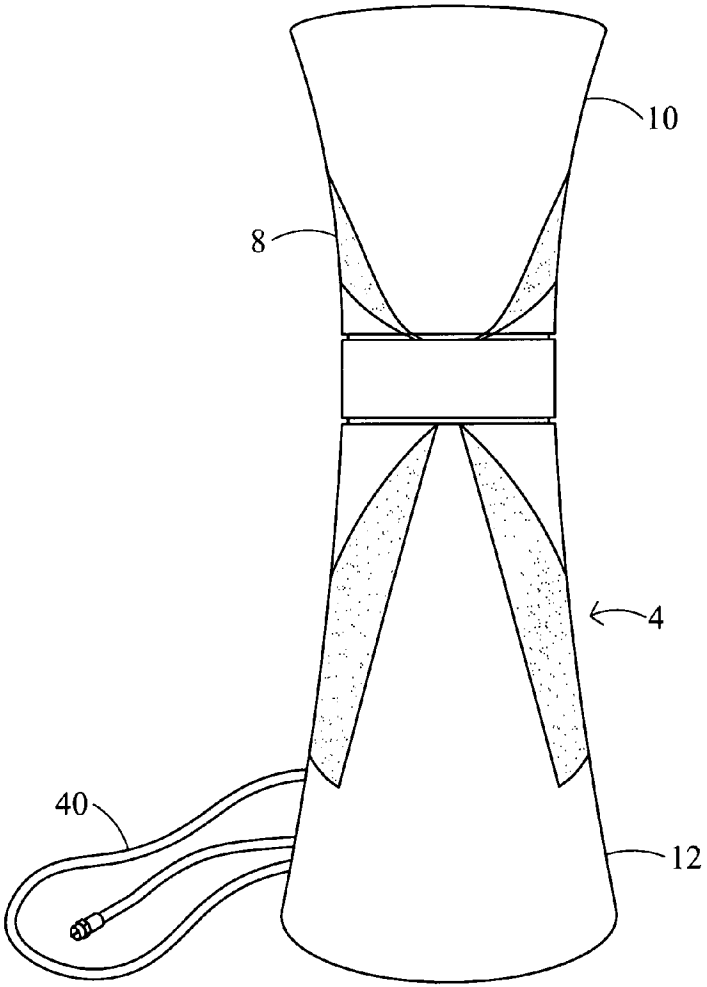
FIG. 10 is a front isometric view of the cloverleaf antenna of the present invention shown in FIG. 9 situated within the housing.

The cloverleaf antenna 4 of the present invention may also be formed from a pair of preferably solid bowtie antennas 26, each bowtie antenna 26 having a planar shape as shown in FIG. 9. Each "bow" portion 36, 38 of each bowtie antenna 26 is in the form of an equilateral triangle, each side of which preferably having a length equal to about 14 millimeters or scaled to proportional smaller or larger dimensions. One corner of one "bow" portion 36 of the bowtie antenna 26 faces and is in alignment with a corner of the other "bow" portion 38 of the bowtie antenna 26. Again, two bowtie antennas 26, such as shown in FIG. 9, are used to form the dual bowtie, or cloverleaf, antenna 4 of the present invention. The centers of the bowtie antennas 26 overlap or are in proximity to each other to define a cloverleaf antenna 4 which is placed inside (or on the outside surface 20 of) the hourglass-shaped vase housing 8. As with the embodiment shown in FIG. 8, the embodiment of FIG. 9 has one "bow" portion 36 of each bowtie antenna 26 residing in the upper conically-shaped segment 10 of the housing, with the other "bow" portion 38 of each bowtie antenna 26 residing in the lower conically-shaped segment 12 of the housing 8, as shown in FIG. 10 of the drawings. The center of the cloverleaf antenna 4 defined by the two bowtie antennas 26 preferably is situated in alignment with the narrower middle portion 14 of the hourglass-shaped vase housing 8. Also, the bowtie antennas 26 shown in FIGS. 8 and 9 are center fed and are connected internally to a coaxial cable 40, as shown in FIG. 10, preferably passing through the thickness of the lower conically-shaped segment 12 of the housing 8.

Figure 6:
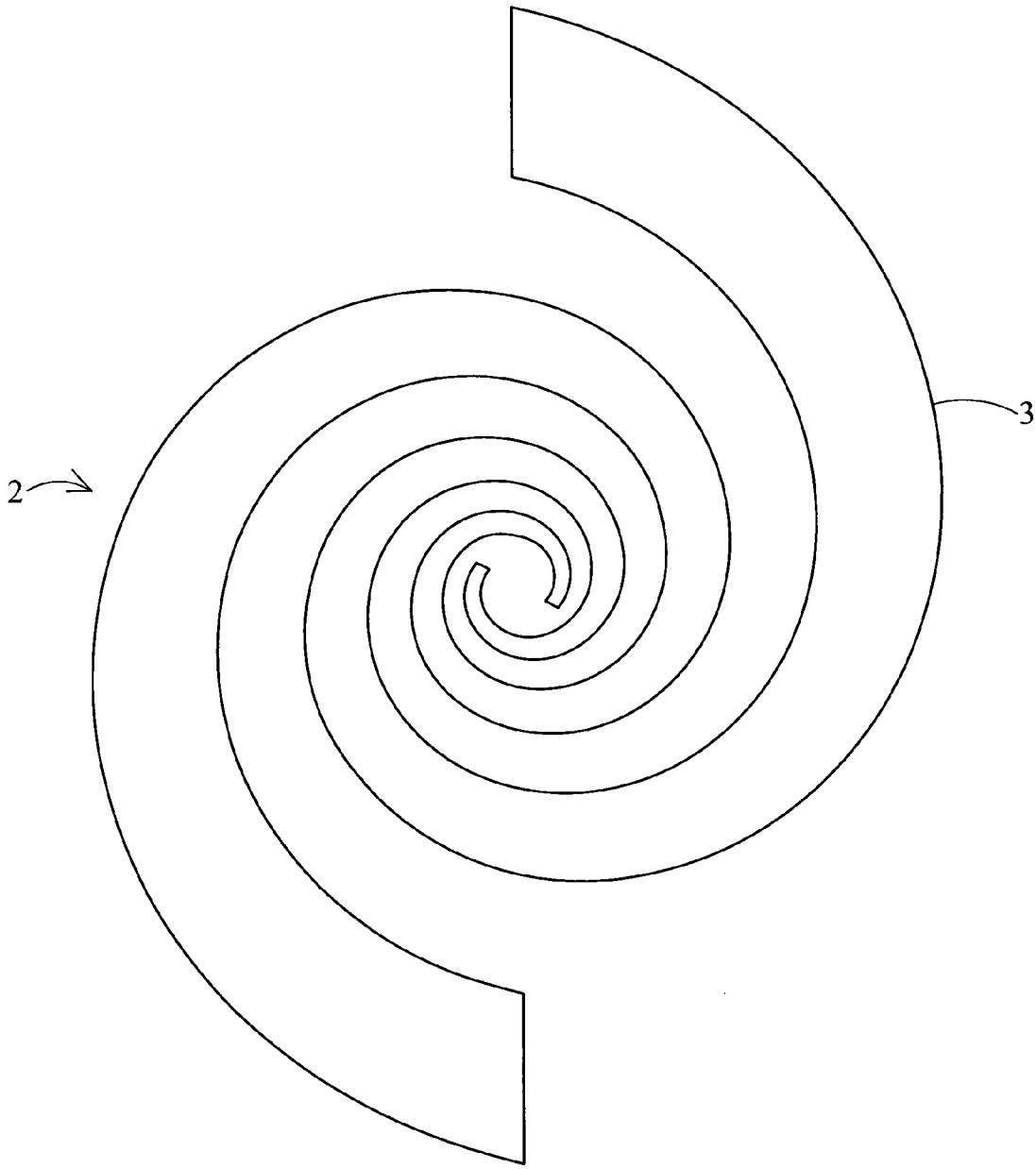
FIG. 6 is a top plan view of one form of the antenna of the present invention, the antenna being a spiral antenna, prior to it being situated within the housing.
Figure 7:
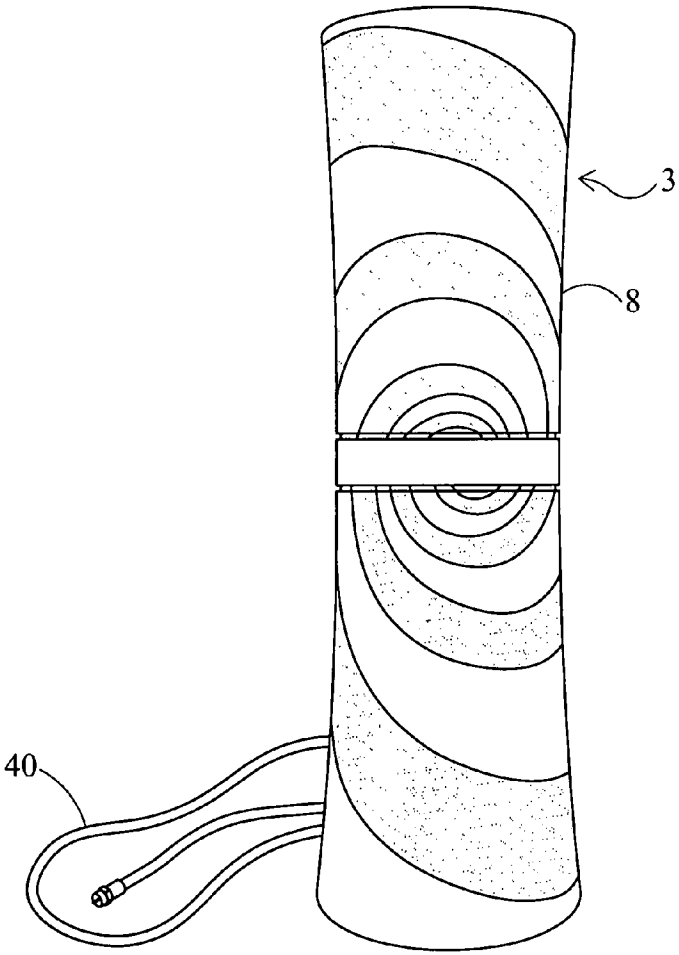
FIG. 7 is a front isometric view of the spiral antenna of the present invention shown in FIG. 6 situated within the housing.

Rather than a pair of bowtie antennas 26, the present invention may have a spiral antenna 3 situated within (or on the outer surface 20 of) the hourglass-shaped vase housing 8, as shown in FIG. 7. A preferred form of such a spiral antenna 3 is shown in FIG. 6 of the drawings. As can be seen from FIG. 6, a log Archimedes solid element spiral antenna 3 is preferably used, which provides a relatively frequency-independent response over the bandwidth of interest (for digitally formatted, television signal reception). Like the cloverleaf or dual bowtie antennas 4 discussed previously and shown in FIGS. 8 and 9, the spiral antenna 3 may be formed from a thin, flexible copper sheet material or substrate, or other material such as aluminum or silver, which is conducive to receiving digitally formatted television signals. Alternatively, the spiral antenna 3 shown in FIG. 6 may be etched into or painted on the inner or outer surface 22, 20 of the hourglass-shaped vase housing 8 using a metallic based paint or other material, such as copper, silver or aluminum, which provides good signal receptivity. The spiral antenna 3 is center fed and connected to a coaxial cable 40, as shown in FIG. 7, and its center is preferably aligned with the narrower middle portion 14 of the hourglass-shaped vase housing 8.

Three sets of tests were performed and measurements were taken for three different embodiments of the present invention. The first embodiment is a spiral antenna 3, such as shown in FIG. 6 of the drawings, situated within an hourglass-shaped vase housing 8 having a height of about 395 millimeters and symmetrical conically-shaped top and bottom segments which are joined at the center, each of the upper and lower conically-shaped segments 10, 12 having opposite end diameters of about 115 millimeters, the housing 8 having a relatively narrower middle portion 14 having a diameter of about 98 millimeters. The spiral antenna 3 is center fed.

The second embodiment of the present invention uses dual bowtie antennas 26, such as shown in FIG. 9 of the drawings, to define a cloverleaf antenna 4. The antenna 4 is housed in a smaller hourglass-shaped vase housing 8 from that of the first embodiment which was tested. The housing 8 includes non-symmetrical upper and lower conically-shaped segments 10, 12 with an off-center narrower middle portion 14 having a diameter of about 80 millimeters. The height of the housing 8 is about 330 millimeters and the diameter of the opposite top and bottom ends 16, 18 of the housing 8 is about 130 millimeters. The two bowtie antennas 26 define a cloverleaf antenna 4 whose center is preferably aligned with the off-centered narrower portion 14 of the housing 8.

The third embodiment of the present invention which was tested is similar to the second embodiment, except that the housing 8 is coated with a paint on the outer surface 20 thereof so that it is essentially opaque.

FIGS. 11, 15 and 19 are charts of antenna gain at vertical measured at selected frequencies respectively for each of the three aforementioned tested embodiments, the first being a relatively large housing 8 in which a spiral antenna 3 is situated, the second being a relatively smaller housing 8 having a cloverleaf antenna 4 situated therein and the third in the same sized housing 8 and having the same cloverleaf antenna 4 as the second embodiment but having the outer surface 20 of the housing painted.

Figure 12:
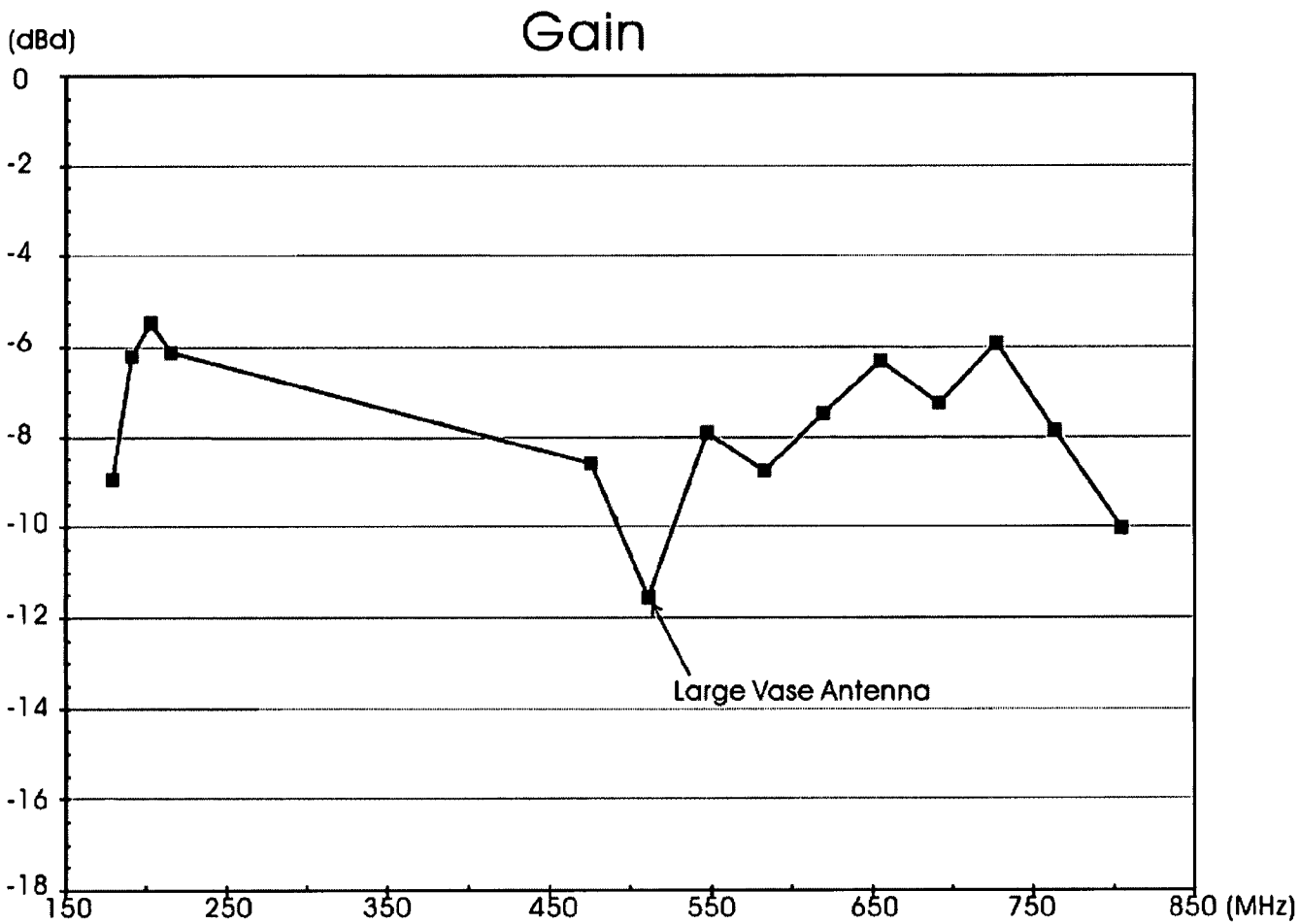
FIG. 12 is a graph of gain (in dBd) measured against frequency (in MHz) for a spiral antenna, such as shown in FIG. 6, situated in the hourglass-shaped vase housing, as shown in FIG. 7, and formed in accordance with the present invention.
Figure 16:
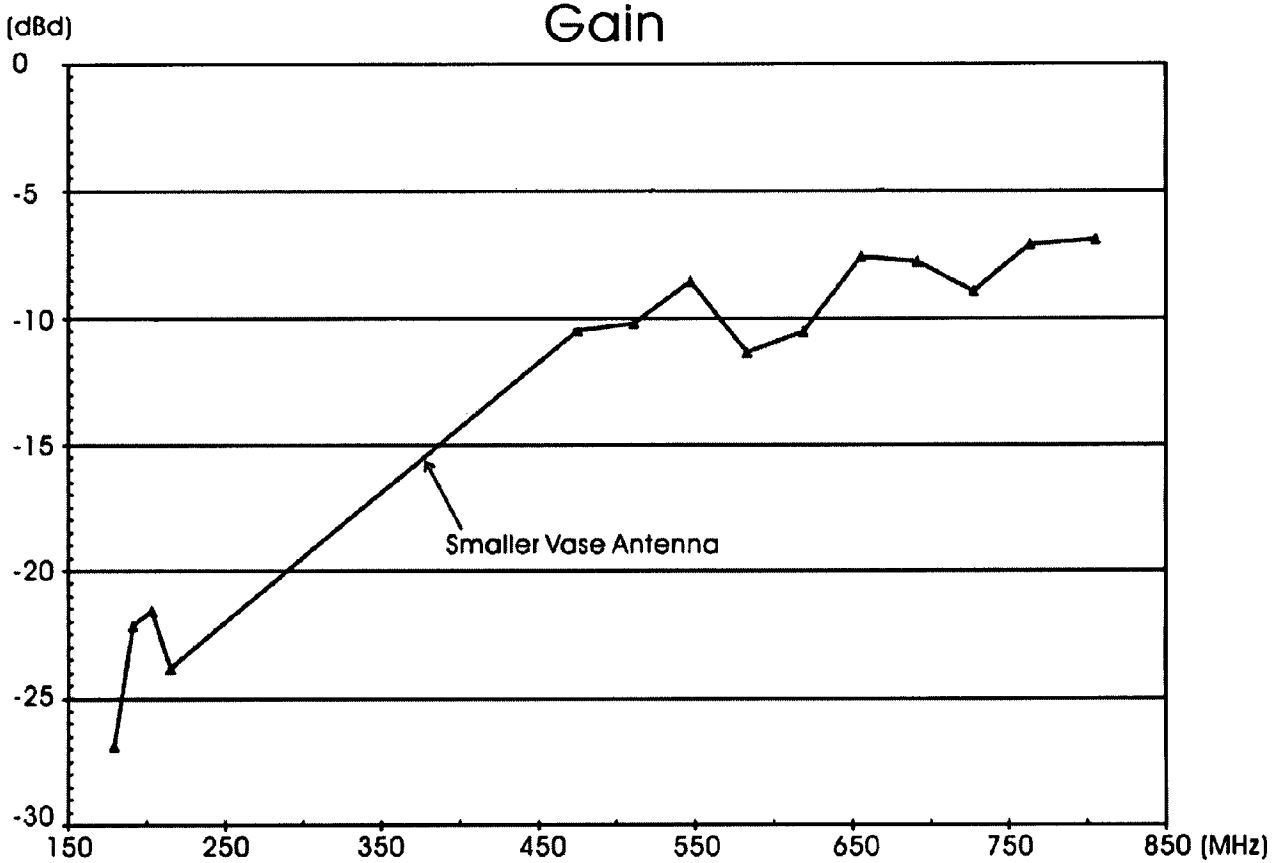
FIG. 16 is a graph of gain (in dBd) measured against frequency (in MHz) for a cloverleaf antenna formed of two bowtie antennas, such as shown in FIG. 9, situated within the hourglass-shaped vase housing, as shown in FIG. 10, and formed in accordance with the present invention.
Figure 20:
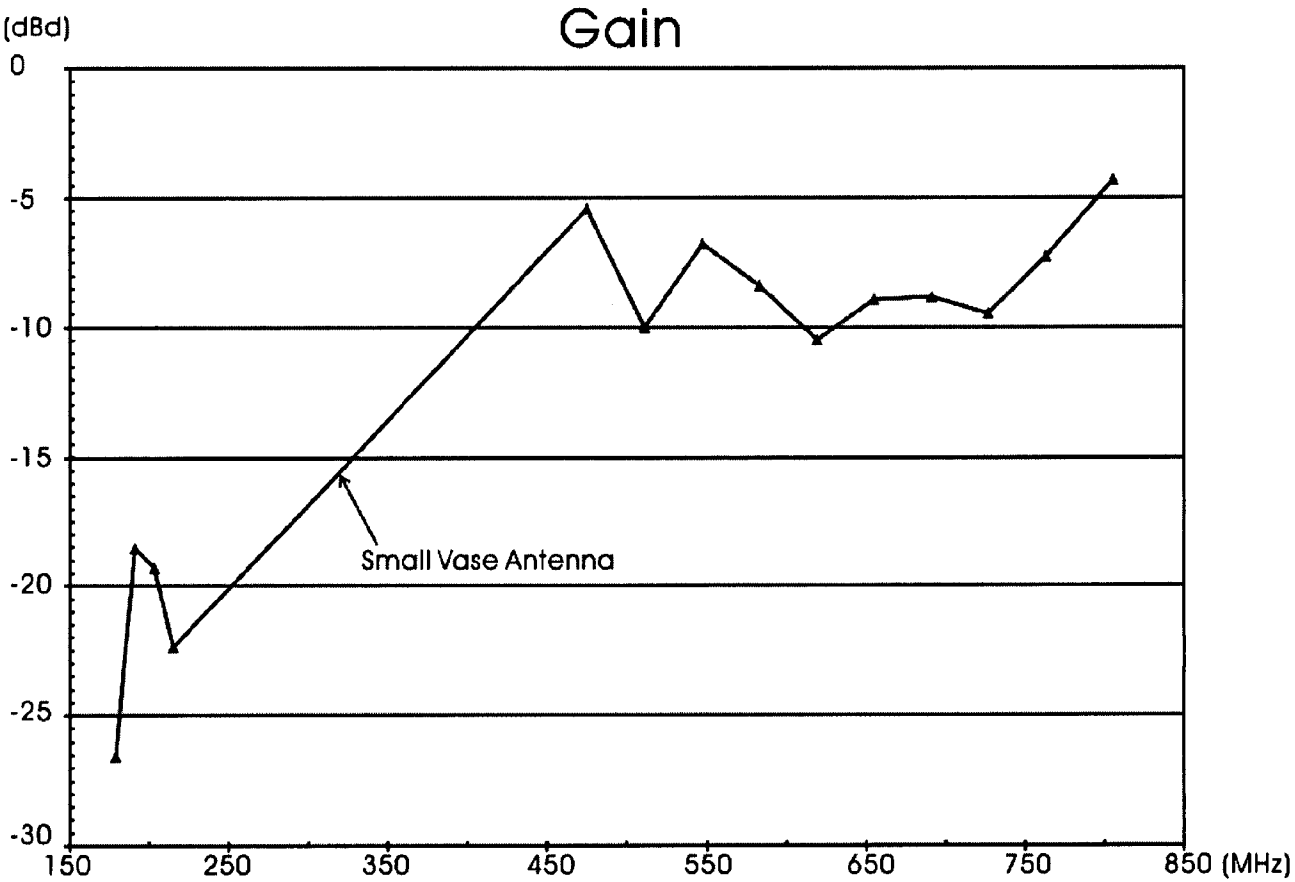
FIG. 20 is a graph of gain (in dBd) measured against frequency (in MHz) for a cloverleaf antenna formed of two bowtie antennas, such as shown in FIG. 9, situated within the hourglass-shaped vase housing, as shown in FIG. 10, which in this situation is painted on the outer surface thereof, and formed in accordance with the present invention.

FIGS. 12, 16 and 20 are graphs of antenna gain versus frequency respectively for each of the three tested embodiments of the present invention described previously.

Figure 13:
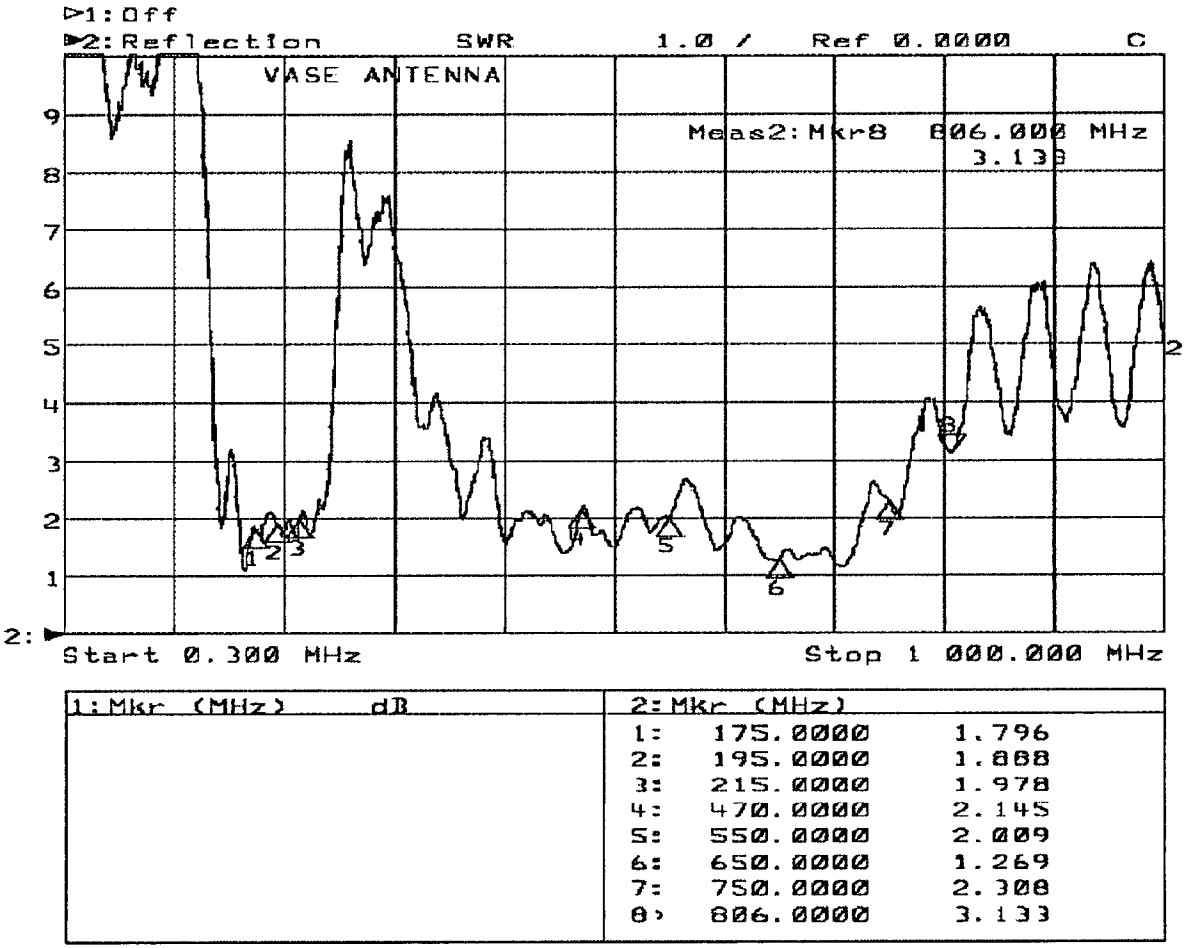
FIG. 13 is a graph of VSWR (voltage standing wave ratio) plotted against frequency (in MHz) for a spiral antenna, such as shown in FIG. 6, situated in the hourglass-shaped vase housing, as shown in FIG. 7, and formed in accordance with the present invention.
Figure 14A:
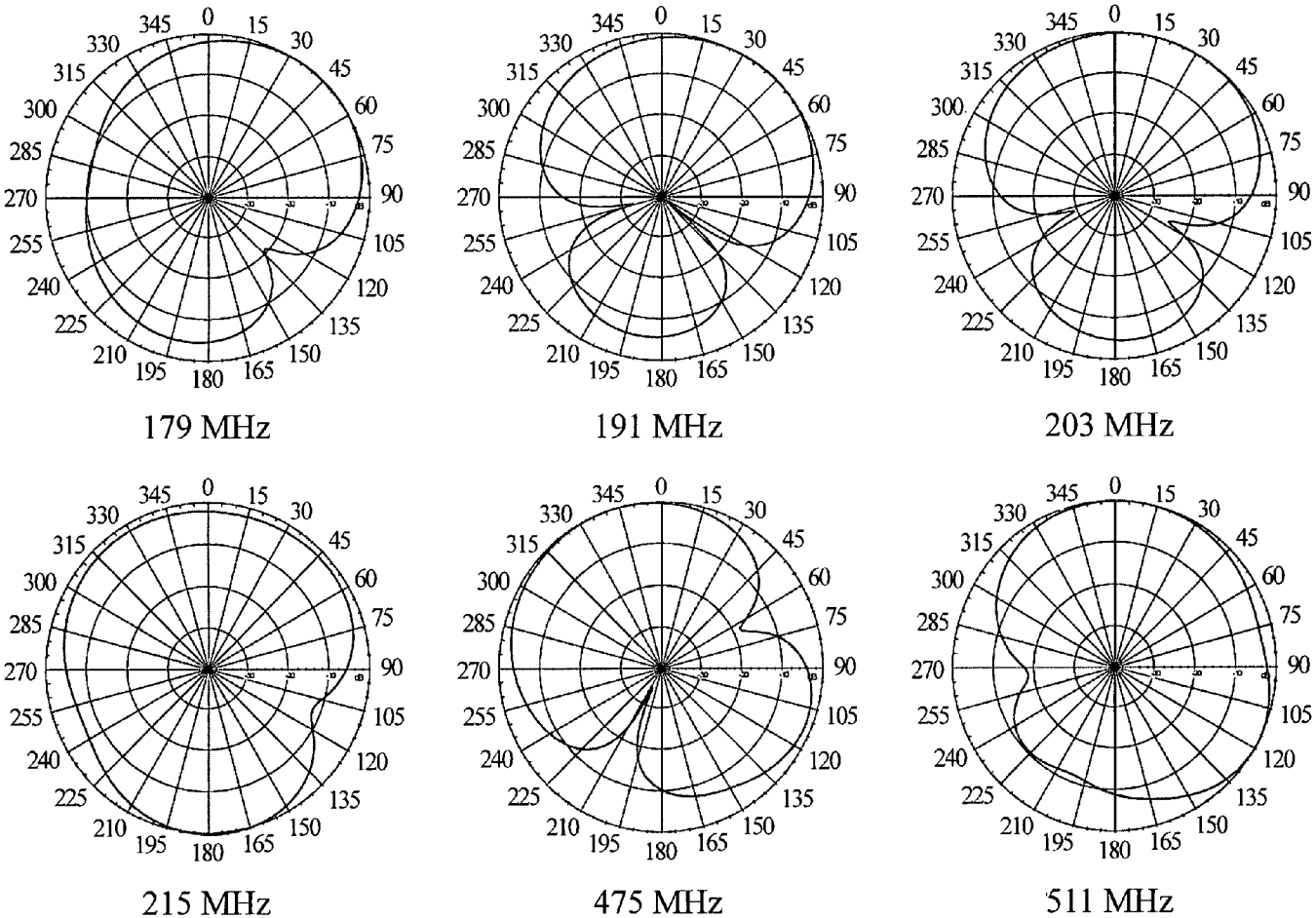
FIGS. 14A, 14B and 14C are a series of radiation patterns at vertical measured at certain frequencies (in MHz) for a spiral antenna, such as shown in FIG. 6, situated in the hourglass-shaped vase housing, as shown in FIG. 7, and formed in accordance with the present invention.
Figure 14B:
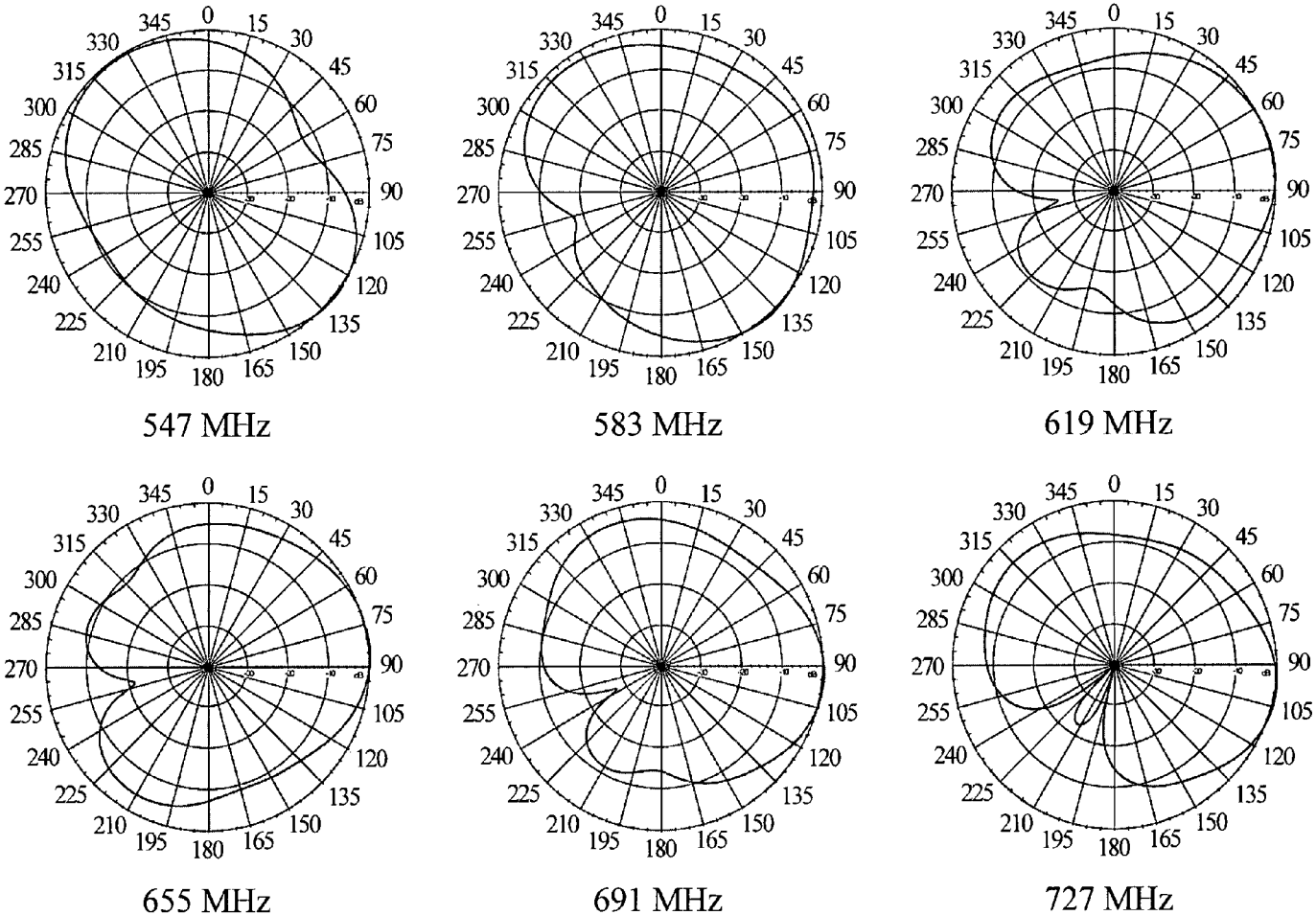
Figure 14C:
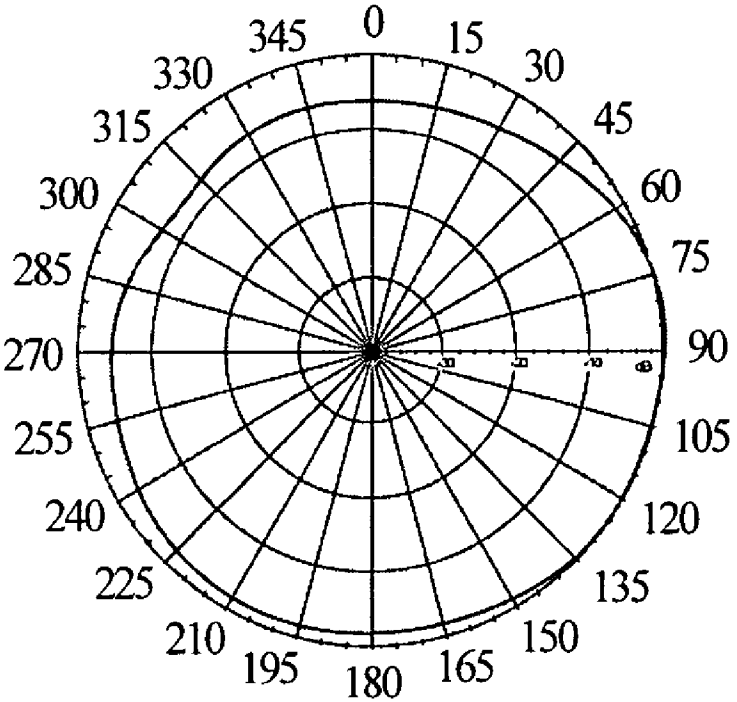
Figure 14C:
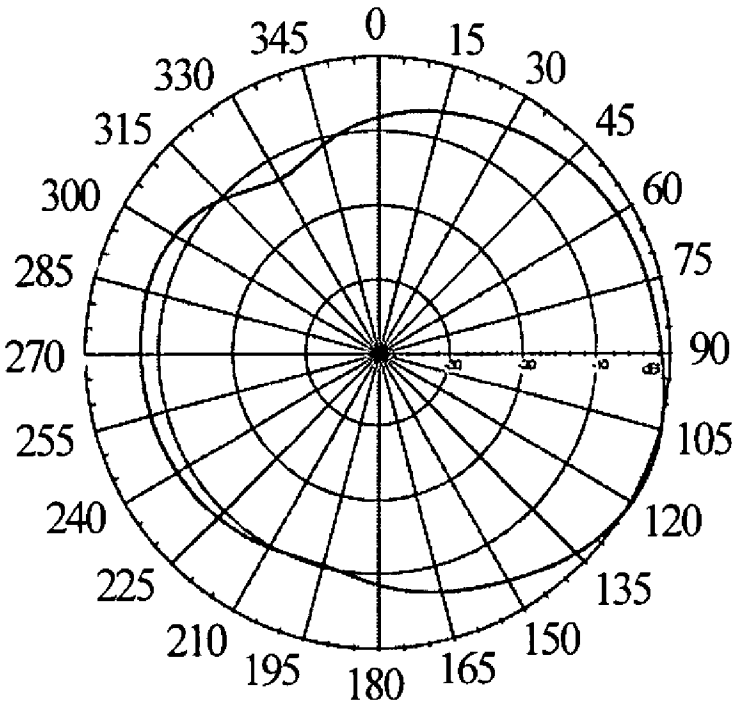
Figure 17:
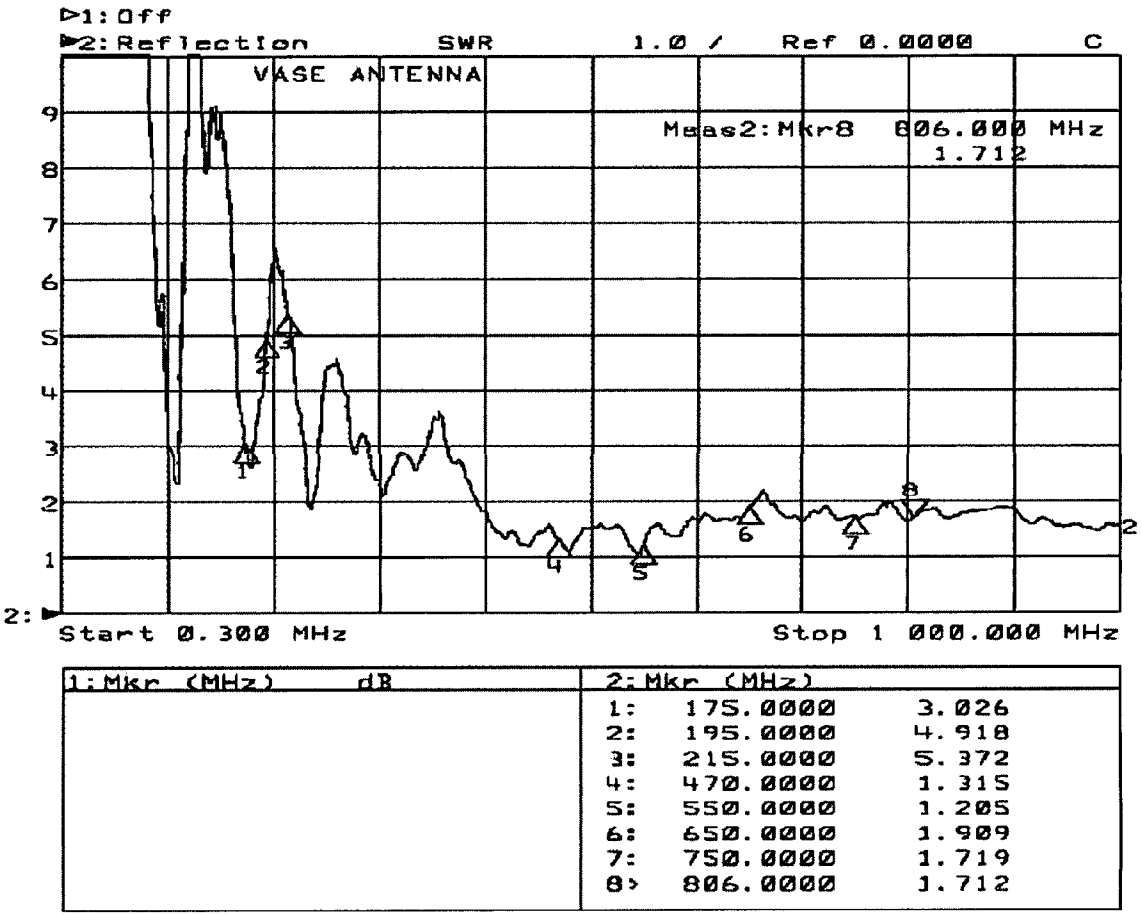
FIG. 17 is a graph of VSWR (voltage standing wave ratio) measured against frequency (in MHz) for a cloverleaf antenna formed of two bowtie antennas, such as shown in FIG. 9, situated within the hourglass-shaped vase housing, as shown in FIG. 10, and formed in accordance with the present invention.
Figure 18A:
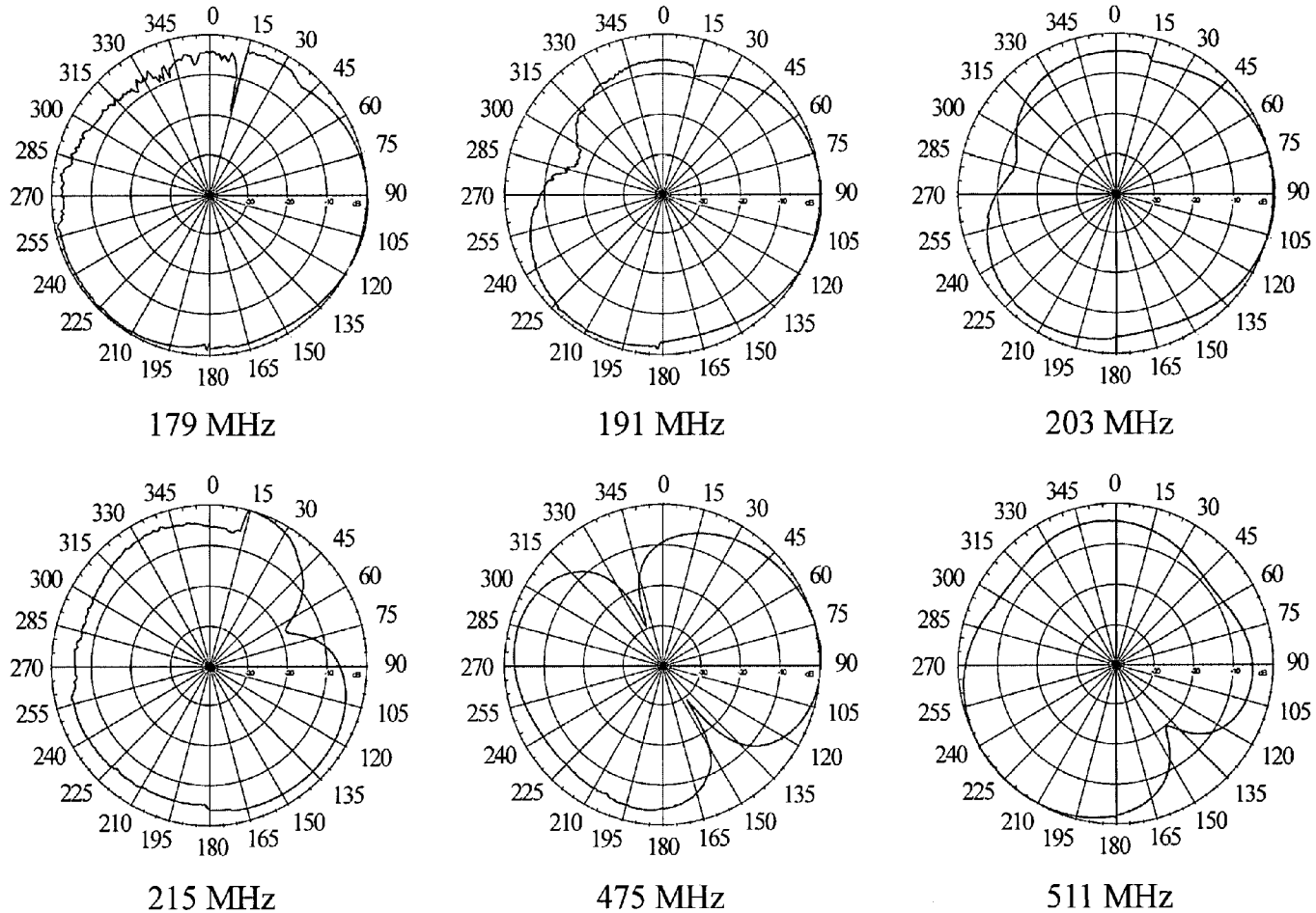
FIGS. 18A, 18B and 18C are a series of radiation patterns at vertical measured at certain frequencies (in MHz) for a cloverleaf antenna formed of two bowtie antennas, such as shown in FIG. 9, situated within the hourglass-shaped vase housing, as shown in FIG. 10, and formed in accordance with the present invention.
Figure 18B:
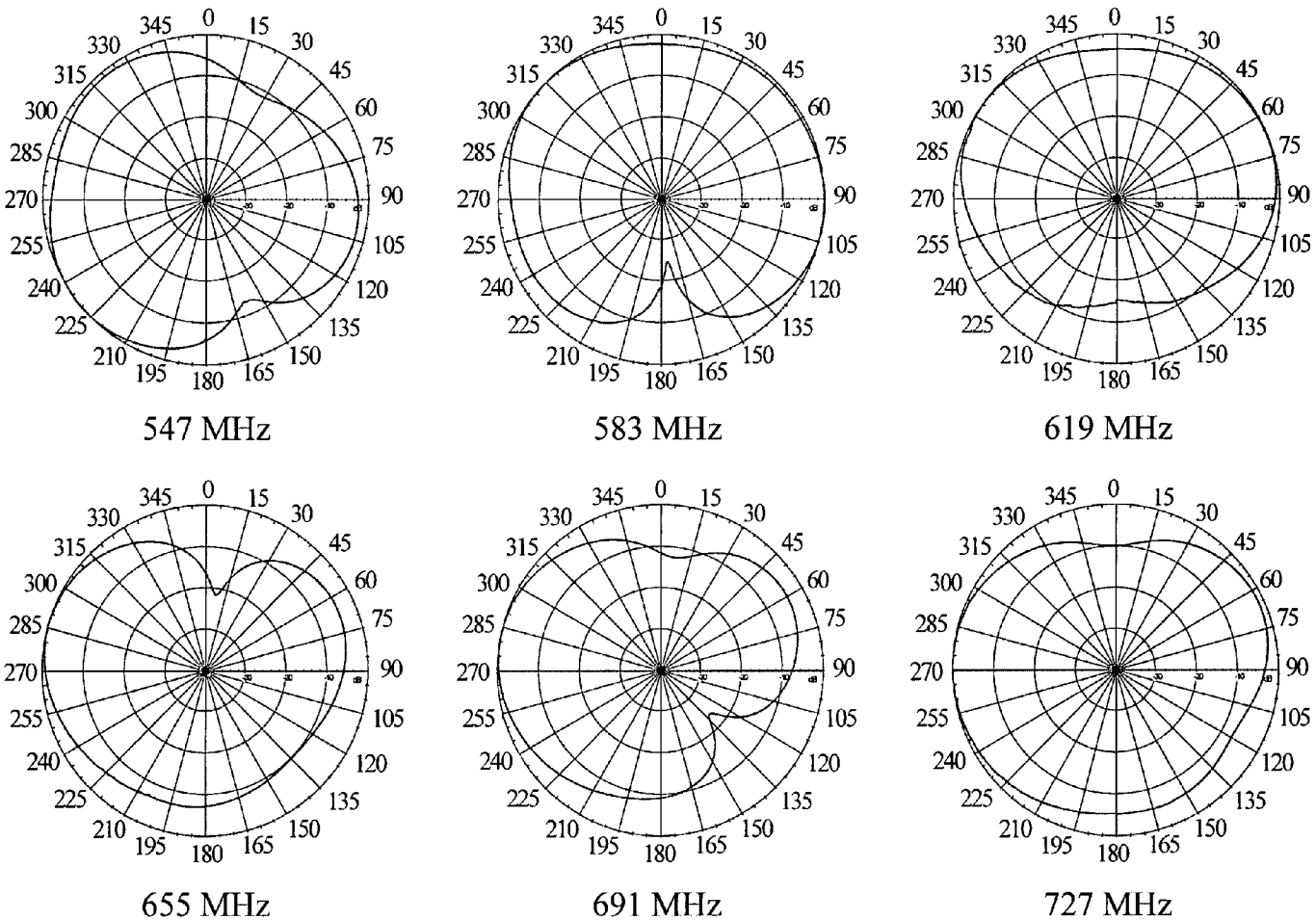
Figure 18C:
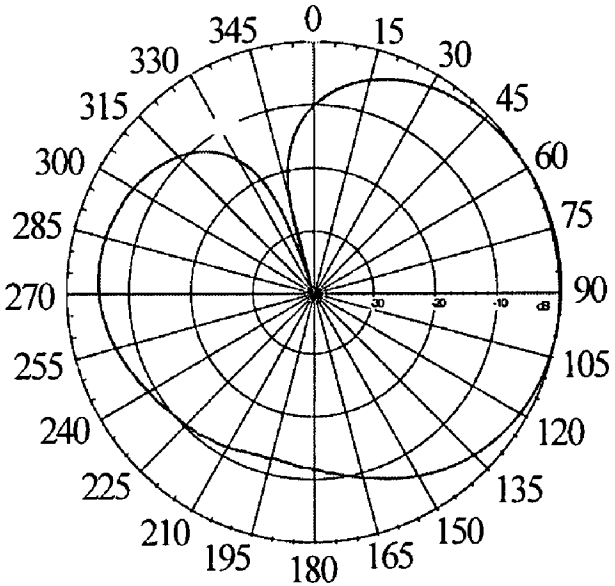
Figure 18C:
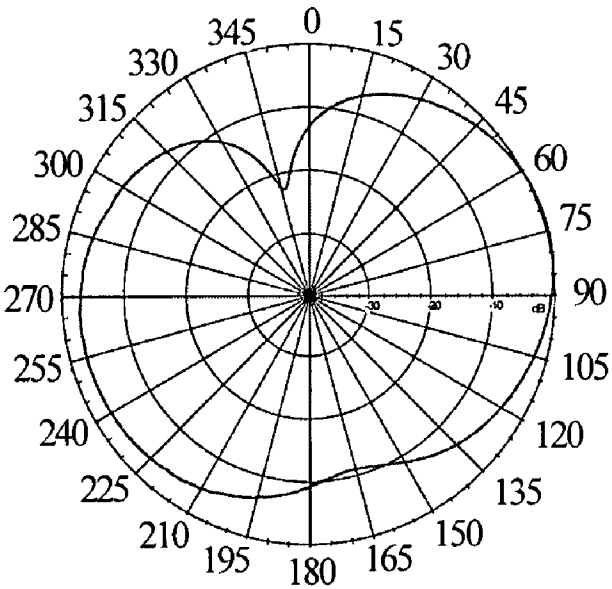
Figure 21:
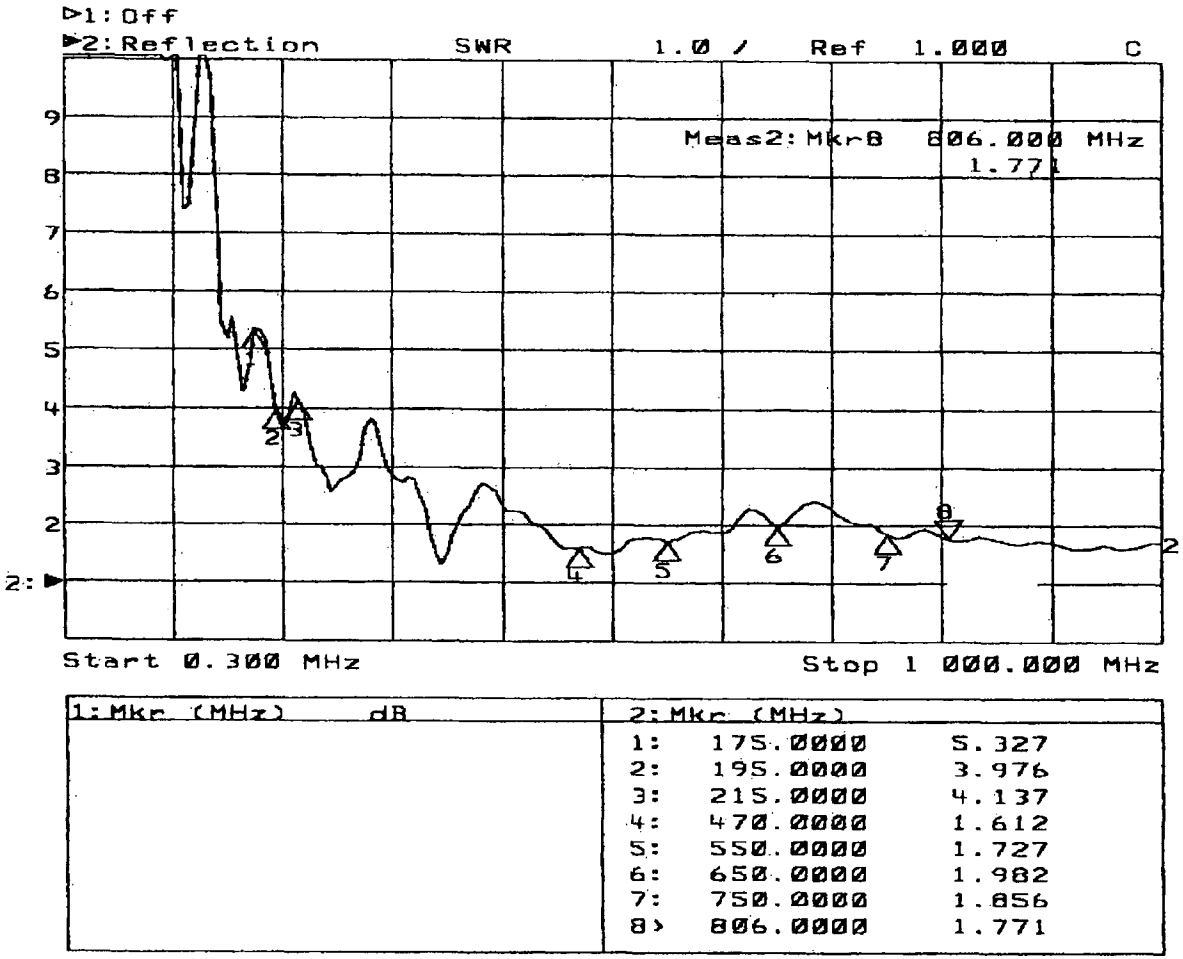
FIG. 21 is a graph of VSWR (voltage standing wave ratio) measured against frequency (in MHz) for a cloverleaf antenna formed of two bowtie antennas, such as shown in FIG. 9, situated within the hourglass-shaped vase housing, as shown in FIG. 10, which in this situation is painted on the outer surface thereof, and formed in accordance with the present invention.
Figure 22A:
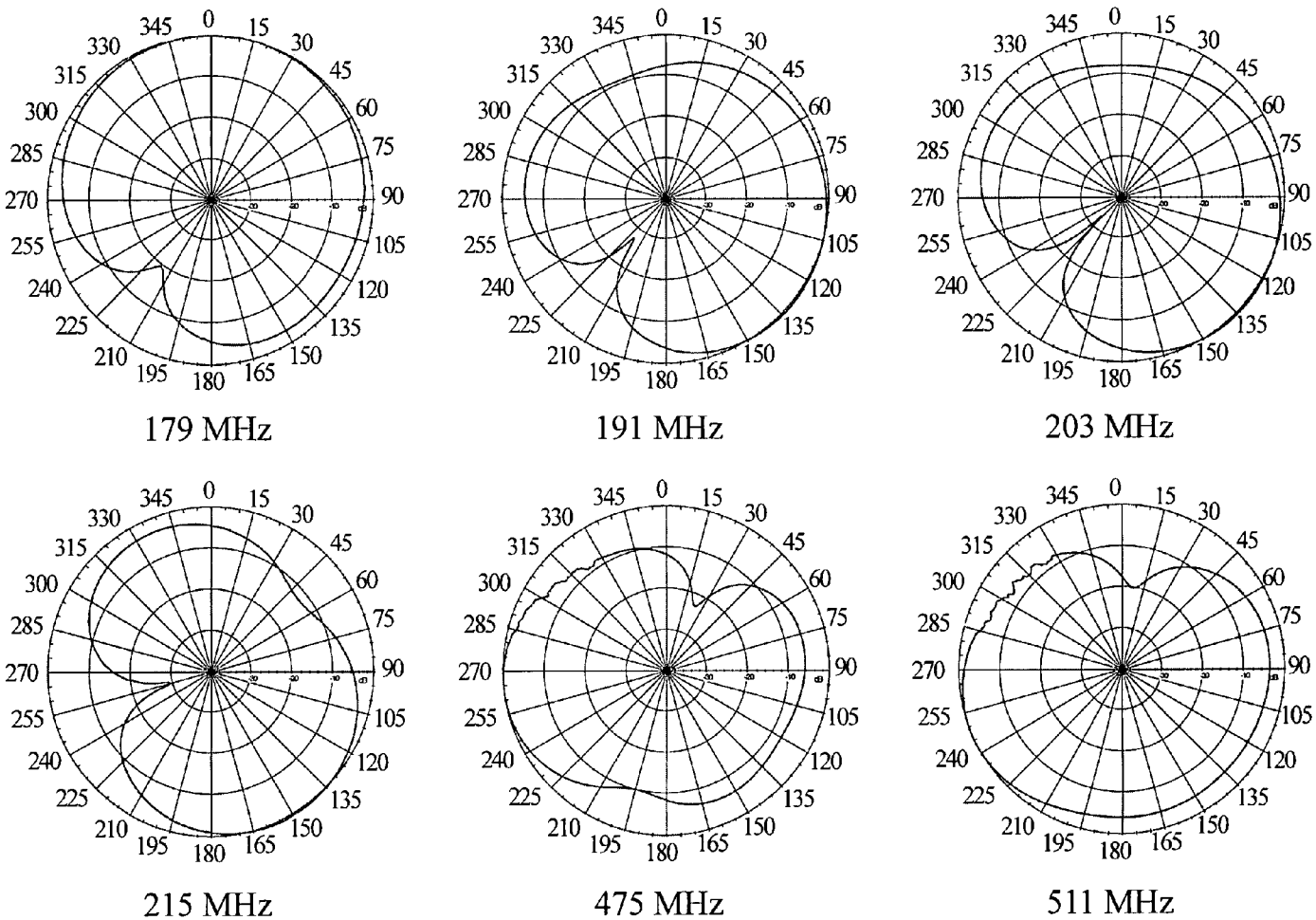
FIGS. 22A, 22B and 22C are a series of radiation patterns at vertical measured at certain frequencies (in MHz) for a cloverleaf antenna formed of two bowtie antennas, such as shown in FIG. 9, situated within the hourglass-shaped vase housing, as shown in FIG. 10, which in this situation is painted on the outer surface thereof, and formed in accordance with the present invention.
Figure 22B:
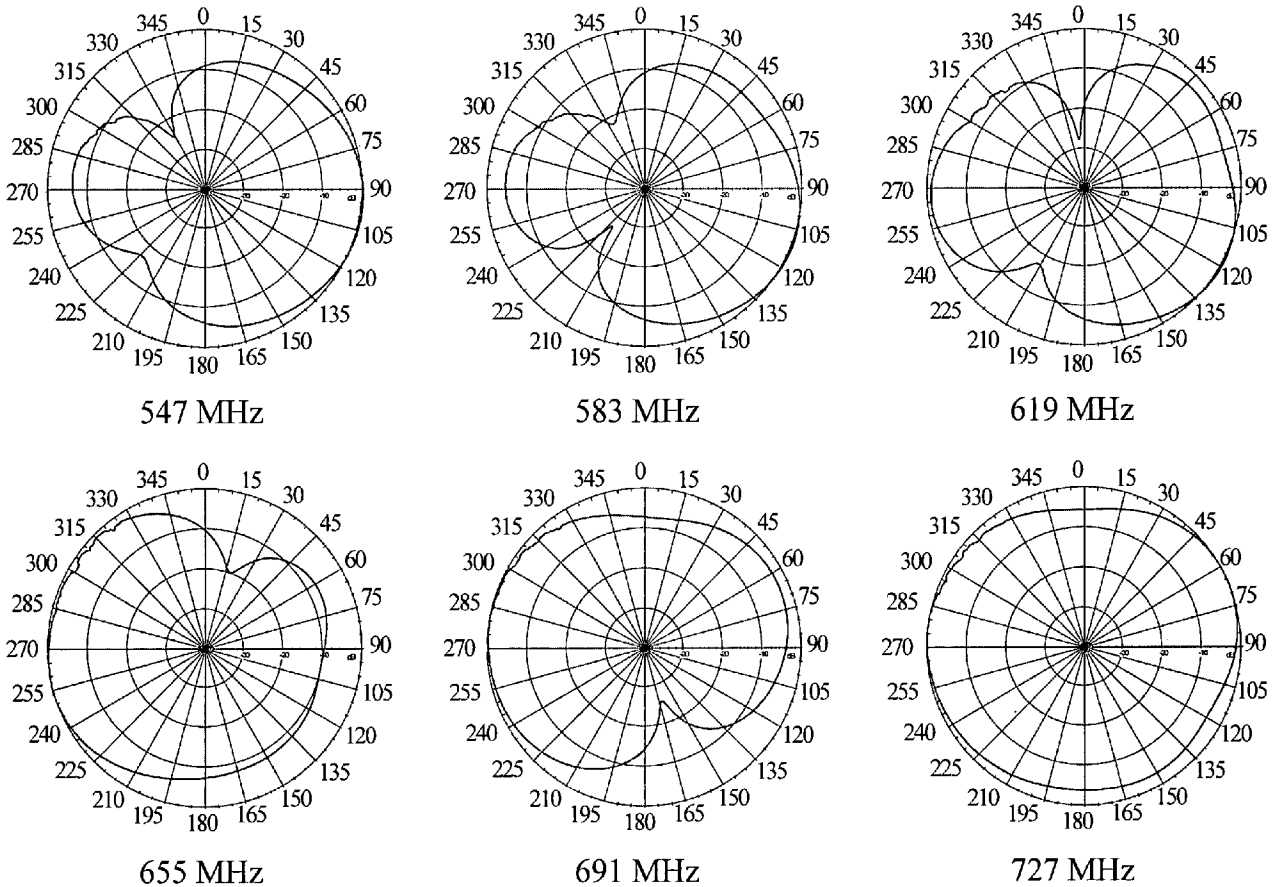
Figure 22C:
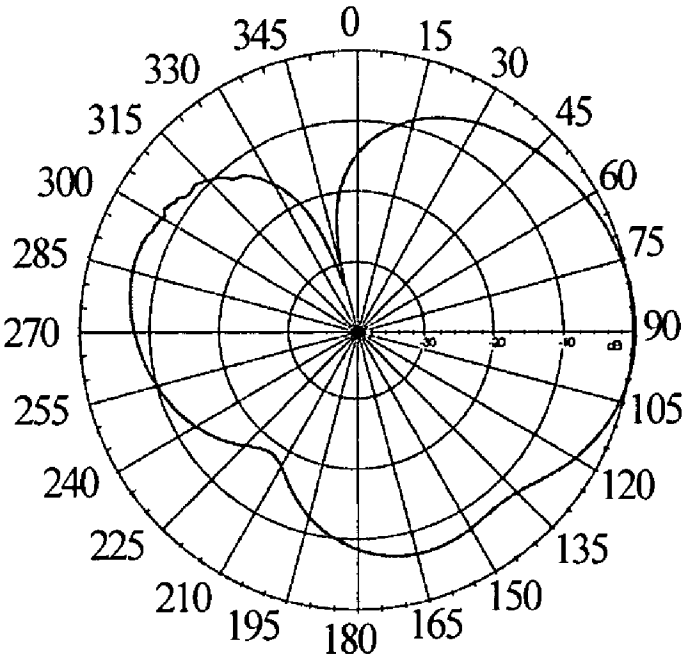
Figure 22C:
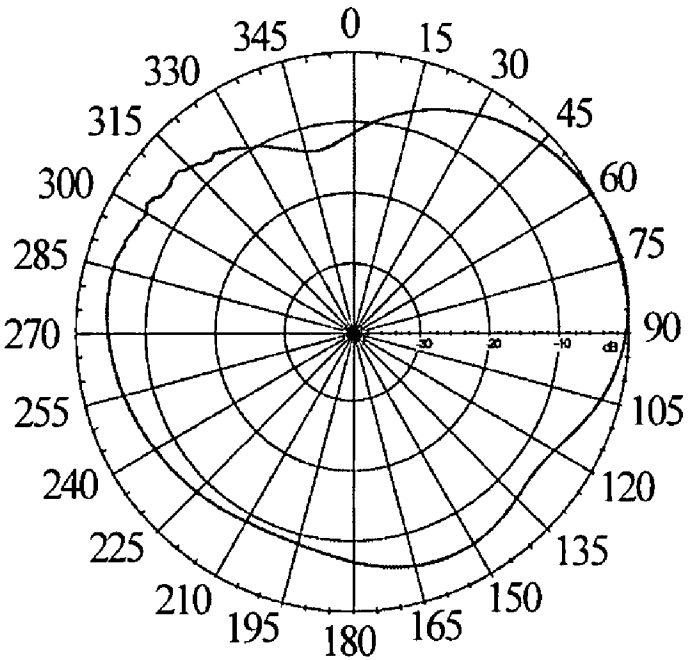
Figure 24:
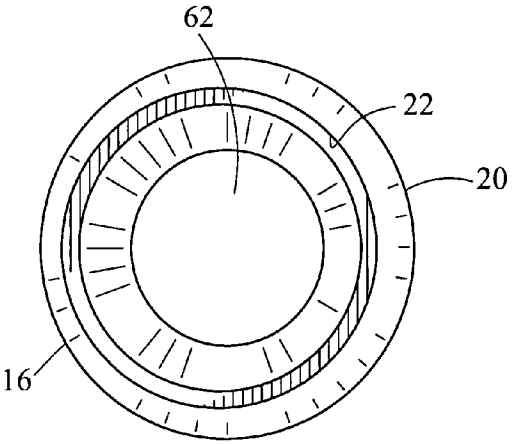
FIG. 24 is a top view of the hourglass-shaped vase antenna housing of the present invention shown in FIG. 23.
Figure 25:
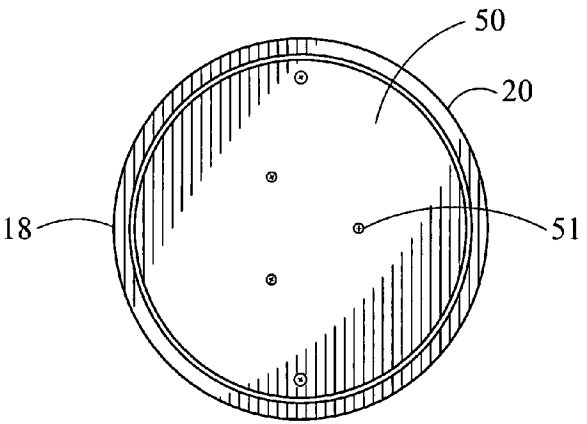
FIG. 25 is a bottom view of the hourglass-shaped vase antenna housing of the present invention shown in FIGS. 23 and 24.
Figure 23:
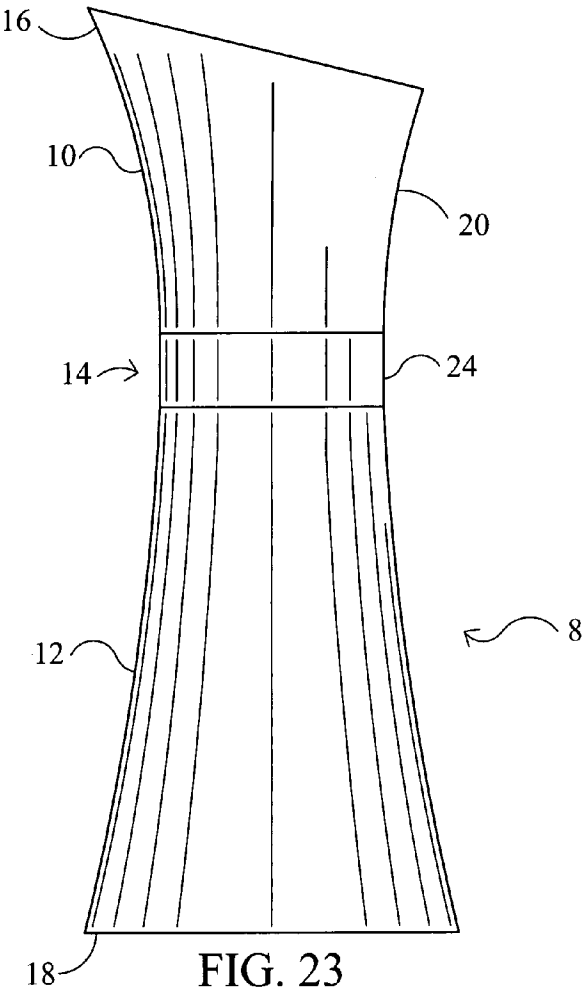
FIG. 23 is a side view of an hourglass-shaped vase antenna housing in which a signal receiving antenna is situated and which is constructed in accordance with another form of the present invention.

FIGS. 13, 17 and 21 are graphs of VSWR (voltage standing wave ratio) plotted against frequency respectively for each of the three tested embodiments of the present invention mentioned previously.

FIGS. 14A, 14B, 14C, 18A, 18B, 18C and 22A, 22B and 22C are radiation or antenna patterns at vertical measured at selected frequencies respectively for each of the three tested embodiments of the present invention mentioned previously.

As can been seen from the charts and graphs shown in FIGS. 11-22C, the antenna 2 of the present invention, situated in a generally hourglass-shaped vase housing 8, provides good omnidirectionality and relatively high gain for good television signal reception, especially for digitally formatted television signals. The generally hourglass-shaped vase housing 8 is aesthetically pleasing so that the user will be more inclined to display the housing 8 in which the antenna 2 is situated in proximity to his television.

Another version of the vase antenna of the present invention is shown in FIGS. 23-39B of the drawings. This version of the vase antenna structure includes an hourglass-shaped housing 8, similar to that described previously and shown in FIG. 1-5, with generally conically-shaped upper and lower segments 10, 12 and a relatively narrower diameter middle portion 14 situated between relatively larger diameter top end portion 16 and a bottom end portion 18. However, the top end portion 16 of the housing 8 is preferably sloped at an angle so that the top edge does not reside in a horizontal plane when the vase antenna is resting upright on a horizontal supporting surface. Furthermore, the bottom end portion 18 of the vase housing 8 has a bottom end cap or base 50 which is mounted to (by screws 51) and removable from the conically-shaped lower segment 12 to obtain access to the interior of the housing 8. The coaxial cable 40 which is connectable to the user's television, digital tuner or other electronic component passes through the conically-shaped lower segment 12 of the vase housing 8 and is coupled to the signal receiving antenna 2 situated within the interior of the housing.

The top end portion 16 of the vase housing 8 of this particular embodiment also has a top end cap 52 which is preferably in the form of a truncated cone having a central opening 54 formed therein at its lower apex. The top end cap 52 is mounted to the generally conically-shaped upper segment 10 of the housing 8 and is removable therefrom.

A cylindrical tube 56 having a closed bottom end 58 and an axially opposite open top end 60 is mounted at its open top end 60 to the lower opening 54 of the top end cap 52. Preferably, the cylindrical tube 56 is watertightly joined to the top end cap 52. The cylindrical tube 56 has a bore 62 extending axially therein between the open top end 60 and the closed bottom end 58. The cylindrical tube 56 has an outer diameter which is less than the diameter of the narrower middle portion 14 of the vase housing 8 so that it may extend axially through the interior of the vase housing. The cylindrical tube 56, affixed to the top end cap 52, is removable with the top end cap 52 from the vase housing 8.

The cylindrical tube 56 serves two primary purposes. First, the tube 56 acts as a support form for the signal receiving antenna 2. As will be described in greater detail, the signal receiving antenna 2 is mounted on a flexible substrate (for example, one or more sheets 64 of Mylar™ or other material) which is wrapped about the cylindrical tube 56. Second, the cylindrical tube 56 defines a cavity with the top end cap 52 of the vase housing for receiving therein flowers, plants, candles or other decorative objects. Accordingly, the housing 8 pleasantly appears simply as a decorative vase in the user's home, and from its exterior, one would not know that it contains and functions as a digital broadcast television signal receiving antenna 2.

As mentioned previously, the internal cylindrical tube 56 preferably forms a watertight seal with the top end cap 52 of the vase housing 8 so that the cavity defined by the cylindrical tube 56 and the top end cap 52 may be filled with water to nourish live plants and flowers received thereby, although the water filling the cylindrical tube 56 may have an effect on the performance characteristics of the signal receiving antenna 2 wrapped about the tube. Although the tube 56 is described herein as preferably being cylindrical in form, it is envisioned to be within the scope of the present invention to form the tube in other shapes, such as square or polygonal in transverse cross-section.

In addition to the cloverleaf, bowtie and spiral antennas described previously and shown in FIG. 6-10 of the drawings, it is envisioned to be within the scope of the present invention to use other forms of signal receiving antennas 2 which provide adequate omnidirectionality and which exhibit a bandwidth that preferably covers the digital broadcast television frequencies. Two additional preferred forms of signal receiving antennas, constructed in accordance with the present invention, are shown in FIGS. 26-28 and FIGS. 33-35, and their respective gains, omni-direction angles and radiation patterns are shown in FIGS. 29-32B and in FIGS. 36-39B.

Figure 26:
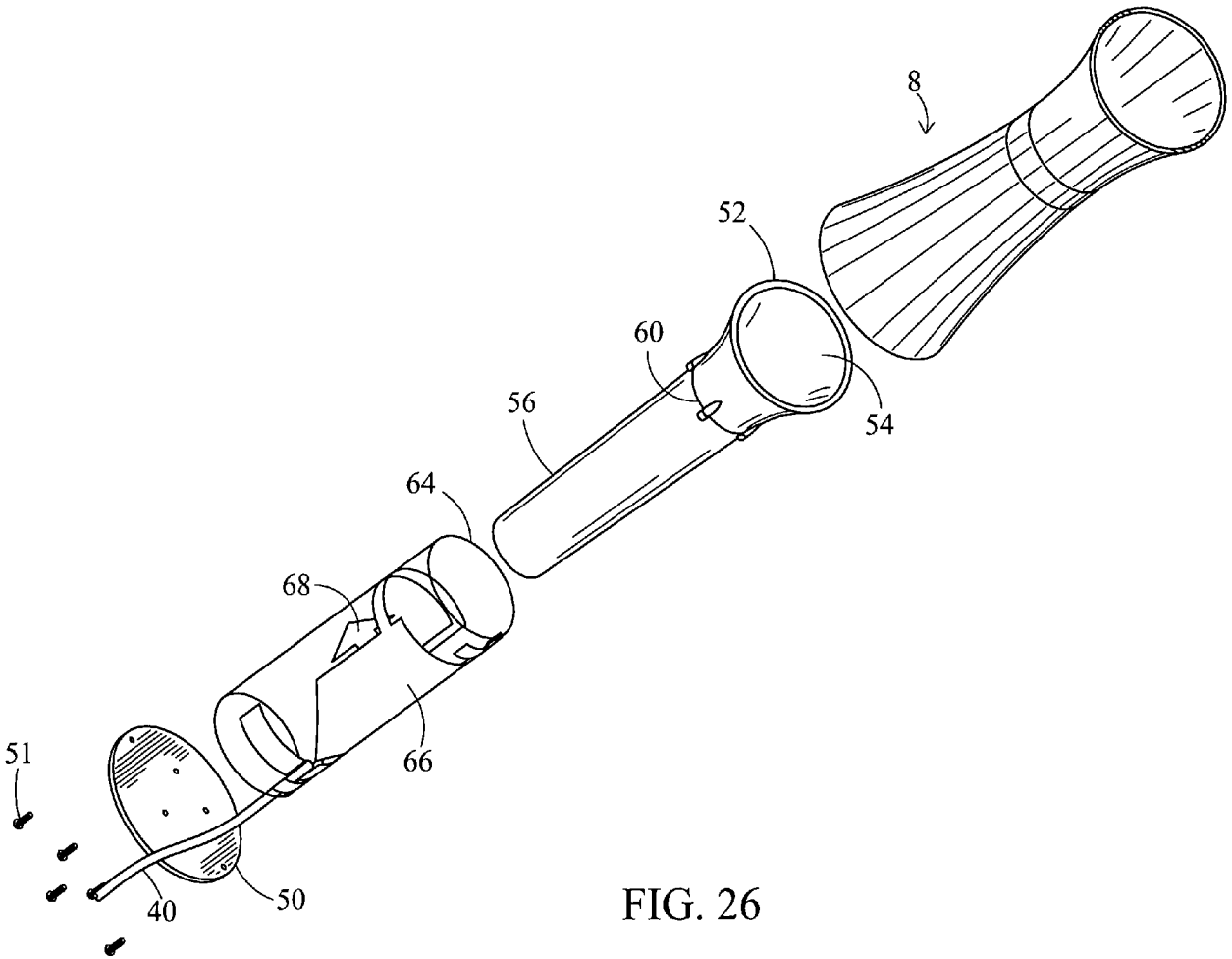
FIG. 26 is an exploded isometric view of the hourglass-shaped vase antenna housing of the present invention and illustrating one form of a signal receiving antenna in a rolled form situated therein and formed in accordance with the present invention.
Figure 27:
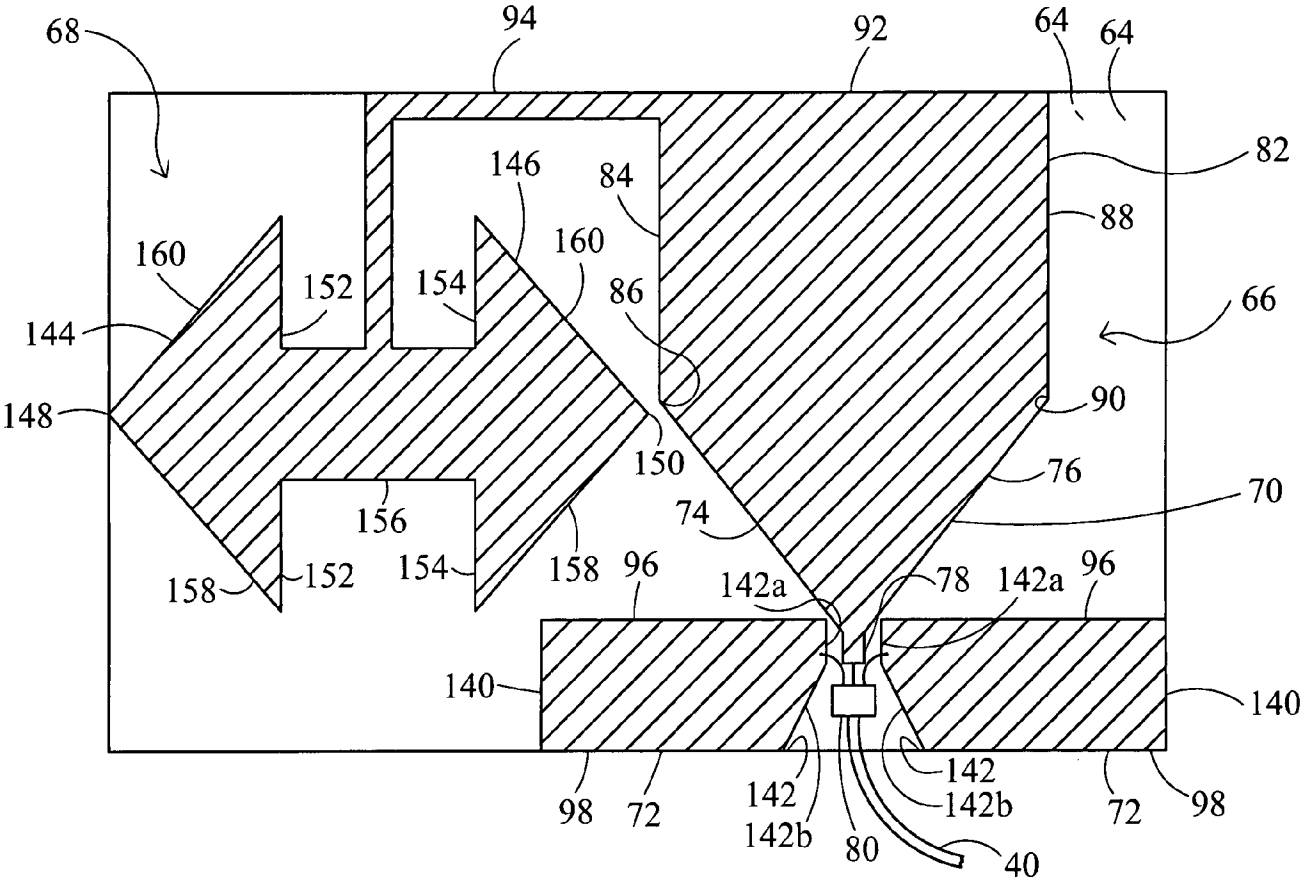
FIG. 27 is a front view of the signal receiving antenna of the present invention shown in FIG. 26 in an unrolled form and prior to its insertion into the vase antenna housing of the present invention.
Figure 28:
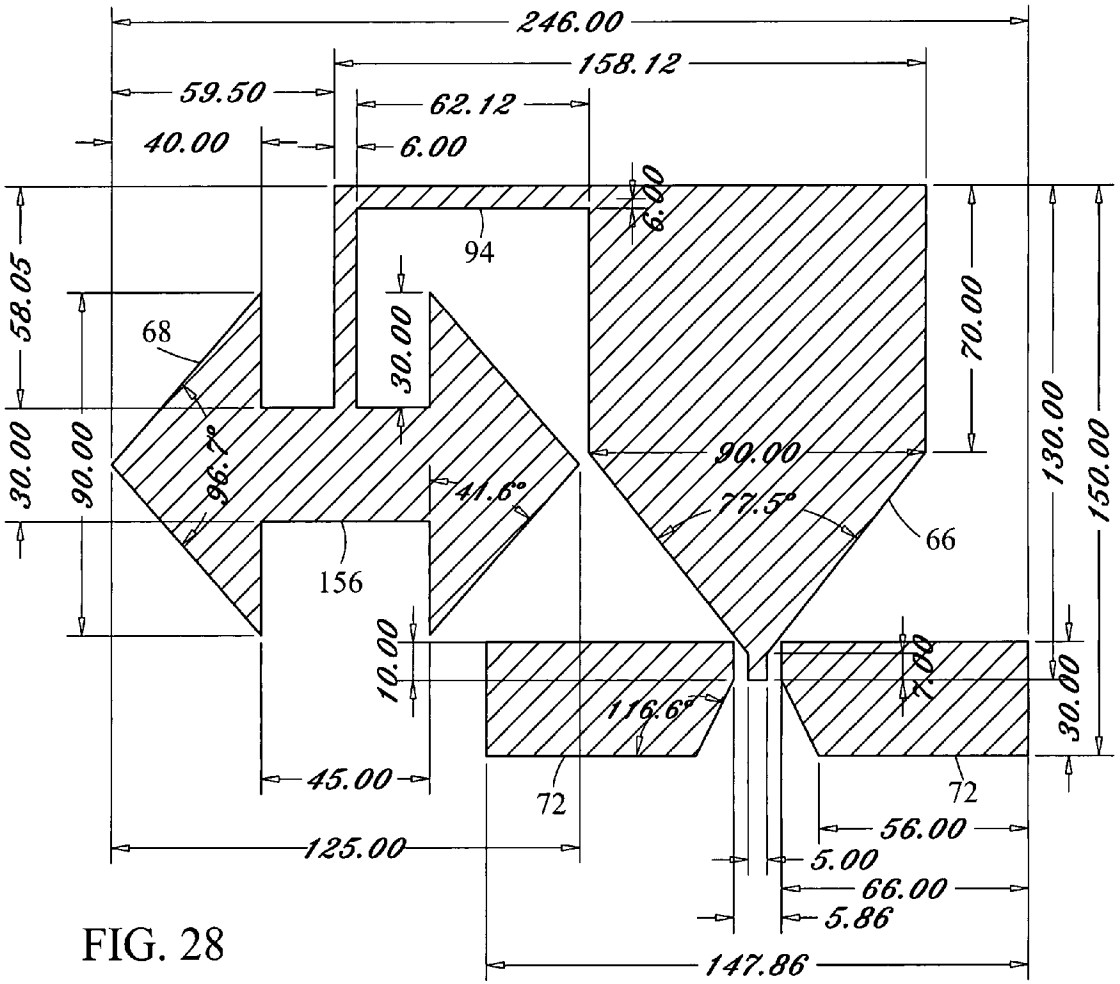
FIG. 28 is a front view of the signal receiving antenna of the present invention shown in FIG. 27 with preferred dimensions of the elements and segments of the antenna being shown.
Figure 31A:
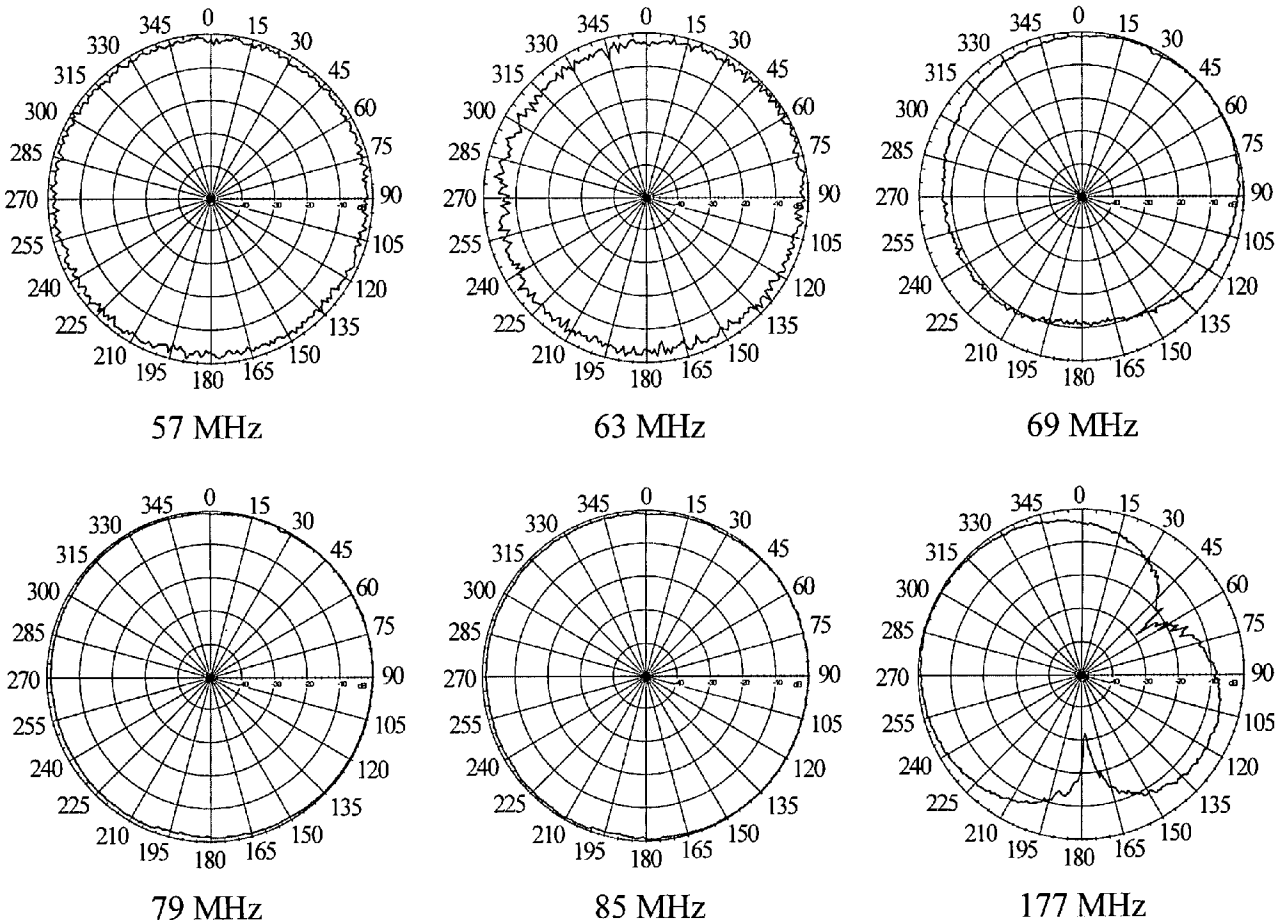
FIGS. 31A and 31B are a series of radiation patterns at vertical measured at certain frequencies (in MHz) in the VHF band for the signal receiving antenna shown in FIGS. 27 and 28, situated within the hourglass-shaped vase antenna housing, as shown in FIGS. 23-26, and formed in accordance with the present invention.
Figure 31B:
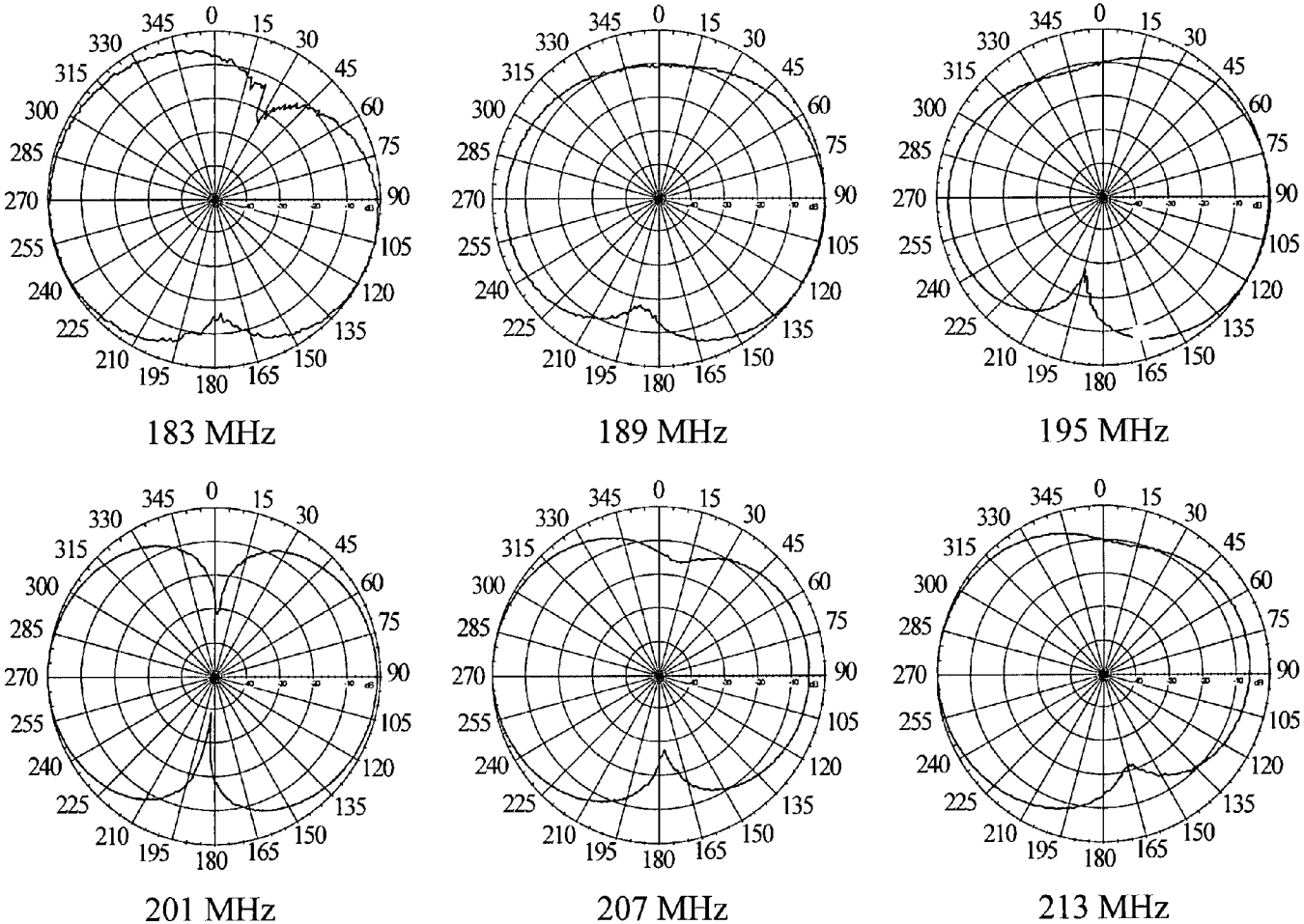
Figure 32A:
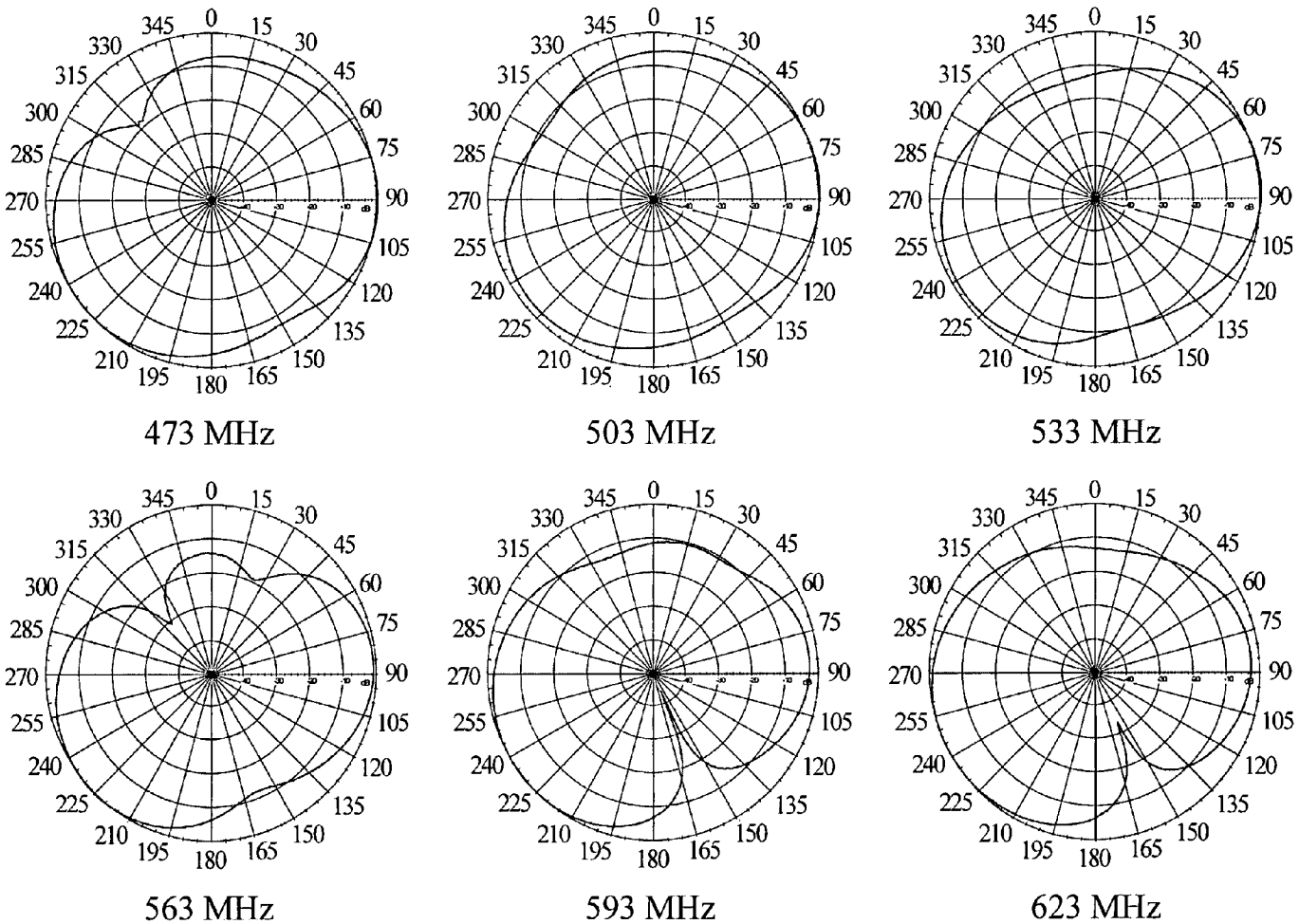
FIGS. 32A and 32B are a series of radiation patterns at vertical measured at certain frequencies (in MHz) in the UHF band for the signal receiving antenna shown in FIGS. 27 and 28, situated within the hourglass-shaped vase antenna housing, as shown in FIGS. 23-26, and formed in accordance with the present invention.
Figure 32B:
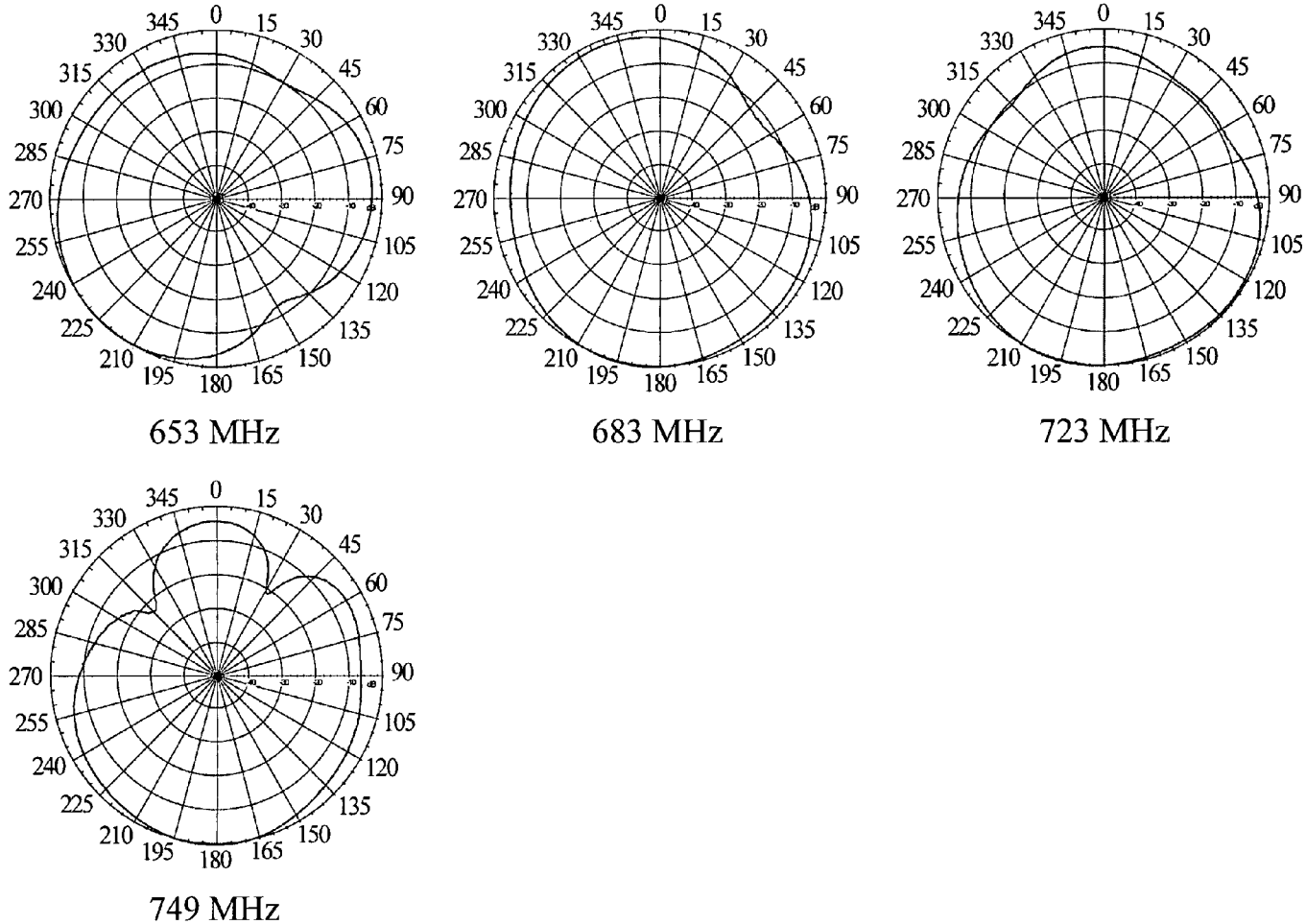

More specifically, and as shown in FIGS. 26-28, a preferred form of an antenna 2 for receiving digital broadcast television signals includes a pair of bowtie antennas 66, 68, one antenna 66 being tuned and oriented vertically (when the vase housing 8 is standing upright) to receive digital broadcast television signals in the VHF (Very High Frequency) band, and the other antenna 68 being tuned and oriented horizontally (when the vase housing 8 is standing upright) to receive digital broadcast television signals in the UHF (Ultra High Frequency) band.

In order to keep the structure of the vase antenna 8 to a reasonable size, the vertically oriented VHF bowtie antenna 66 is preferably formed with only one "bow" element 70. The bow element 70 is positioned vertically (when the vase housing 8 is standing upright) above a pair of horizontally disposed, slightly spaced apart, generally rectangular, electrically conductive lands 72 which together act as a ground plane for the bow element 70 and effectively cut the bowtie antenna 66 in half by eliminating the need for a second, oppositely disposed bow element 70. This reduces the overall length of the VHF antenna 66 and thus the height of the vase housing 8.

The bow element 70 of the VHF antenna 66 is preferably in the form of an inverted, extended triangle having mutually converging lower first and second sides 74, 76, which converge into a small rectangular land 78 (preferably having a length of about 7 millimeters and a width of about 5 millimeters) for connection to a balun transformer 80 and having an opposite rectangular section 82 to define the bow element 70 with a third side 84, joined to the first side 74 at a first obtuse interior angle 86, a fourth side 88, joined to the second side 76 at a second obtuse interior angle 90, and a top fifth side 92 joined to the third and fourth sides 84, 88 at ninety degree (90°) angles. The VHF bowtie antenna 66 (with its ground plane lands 72) is preferably formed from a flexible thin sheet of electrically conductive material (e.g., copper or aluminum or the like), as is the UHF bowtie antenna 68 and a transmission line or strip 94 joined to and interconnecting the VHF and UHF antennas 66, 68, as will be described in greater detail.

One end of the coaxial cable 40 (i.e., the ground shield and center signal conductor) is connected to a 75 ohm-to-300 ohm balun transformer 80, whose outputs are connected to the ground plane lands 72 and to the center rectangular land 78 of the bow element 70. The opposite axial end of the coaxial cable 40 includes a connector which is selected for connection to a television, digital tuner or another electronic component.

The preferred dimensions of the VHF bow element are the following: the first side 74 is about 70 millimeters in length; the second side 76 is about 70 millimeters in length; the third side 84 is about 70 millimeters in length; the fourth side 88 is about 70 millimeters in length; and the fifth side 92 is about 90 millimeters in length. Each generally rectangular land 72 defining the ground plane includes a first side 96 having a length of about 67 millimeters, a slightly smaller second side 98 opposite the first side 96 having a length of about 55 millimeters, a smaller outer third side 140 disposed perpendicularly between the first and second sides 96, 98 and having a length of about 29 millimeters, and a fourth inner side 142 comprised of two segments 142*a* and 142*b* joined together at about a 116.6 degree internal angle and having lengths of about 10 millimeters and 22 millimeters, respectively.

The horizontally disposed UHF bowtie antenna 68 includes two oppositely disposed first and second, triangularly-shaped bow elements 144, 146 having first and second apexes 148, 150, respectively, pointing in opposite directions. The triangular bow elements 144, 146 are separated from each other but are electrically interconnected at their facing base sides 152, 154 with a horizontally elongated, rectangular, transmission line land 156. Each triangular bow element 144, 146 thus has a first side 158 and a second side 160 which mutually converge to form the first and second apexes 148, 150 of the bow elements, and a base side 152, 154 situated opposite the first or second apex 148, 150. Preferably, each triangular bow element 144, 146 of the UHF antenna 68 has the following dimensions: the first side 158 is about 61 millimeters in length; the second side 160 is about 61 millimeters in length; and the base side 152, 154 is about 90 millimeters in length. The rectangular land 156 interconnecting the two triangular bow elements 144, 146 preferably has a length measured between the base sides 152, 154 of the bow elements of about 45 millimeters, and a width of about 30 millimeters. Further dimensions of this signal receiving antenna are shown in FIG. 28. The gain, omni-direction angles and radiation patterns at selected frequencies for the above-described receiving antenna are shown in FIGS. 29-32.

The UHF bowtie antenna 68 is coupled to the VHF bowtie antenna 66 with a transmission line or strip 94. More specifically, the transmission line 94 is joined to the rectangular transmission line 156, which interconnects the two triangular bow elements 144, 146, in the middle of the top side of the rectangular transmission line 156, and is further joined to the third side 84 of the single VHF bow element 66 near where the third side perpendicularly meets the fifth side 92. It appears from test results that this location on the VHF bow element 66 to which to connect the UHF antenna 68 provides good coupling characteristics between the VHF and UHF antennas 66, 68 without the need for discrete coupling capacitors or inductors.

Preferably, the elements of the various antennas 2 described herein and shown in FIGS. 6-10, 27, 28, 34 and 35 for use in the vase antenna structure of the present invention are closed (solid) forms, but it is envisioned to be within the scope of the present invention that the antennas 2 are defined by electrically conductive outlines which encompass open areas.

As further mentioned previously, the signal receiving antennas 2 described herein may be mounted on a flexible sheet 64 of Mylar™ or other material which is wrapped about the cylindrical tube 56. Even more preferably, the electrically conductive material from which the antennas 2 are made, including flexible sheets of conductive material or a conductive paint, for example, is sandwiched within a laminate formed from two sheets 64 of Mylar™ or other electrically non-conductive material which will not substantially alter the performance characteristics of the antenna 2 situated between them. This laminated, flexible structure is then wrapped about the outer surface of the cylindrical tube 56 over at least a portion of the circumference thereof, and the facing or overlapping edges of the laminated structure are taped together to secure the laminated structure of Mylar™ sheets 64 and antenna elements to the cylindrical tube 56. Of course, other methods and means to secure the laminated antenna structure to the cylindrical tube 56 well known in the art (adhesives or glues, for example) may be employed and are envisioned to be within the scope of the present invention.

With respect to the signal receiving antenna shown in FIGS. 26-28, the VHF antenna 66 and the UHF antenna 68 are spaced apart from one another such that, when the antennas 66, 68 and the flexible substrate 64 on which they are mounted are wrapped about the cylindrical tube 56, the VHF antenna 66 and the UHF antenna 68 will be situated with their general centers on diametrically opposite sides of the cylindrical tube 56 (i.e., 180 degrees apart), as shown in FIG. 26 of the drawings.

Figure 33:
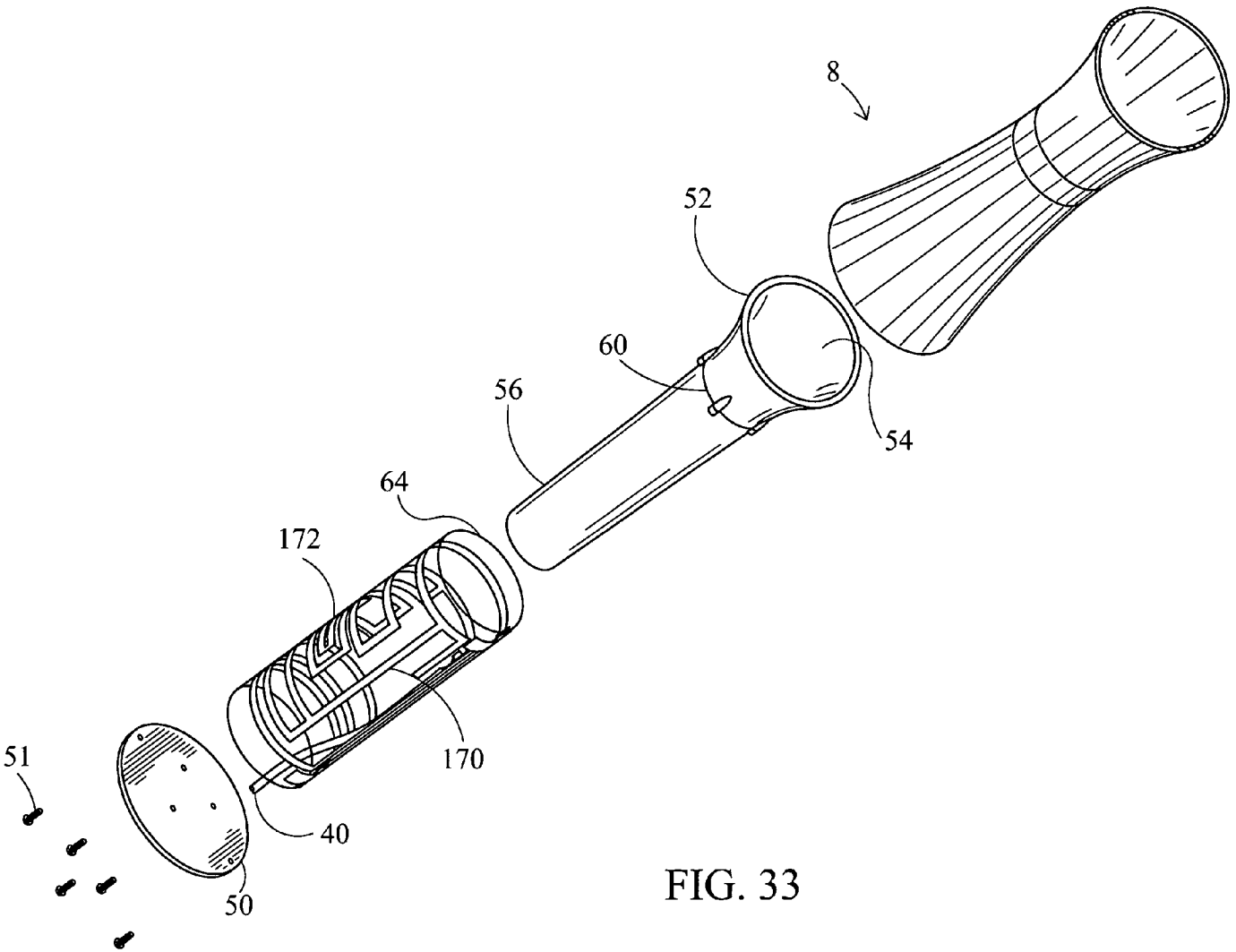
FIG. 33 is an exploded isometric view of the hourglass-shaped vase antenna housing of the present invention and illustrating another form of a signal receiving antenna in a rolled form situated therein and formed in accordance with the present invention.
Figure 34:
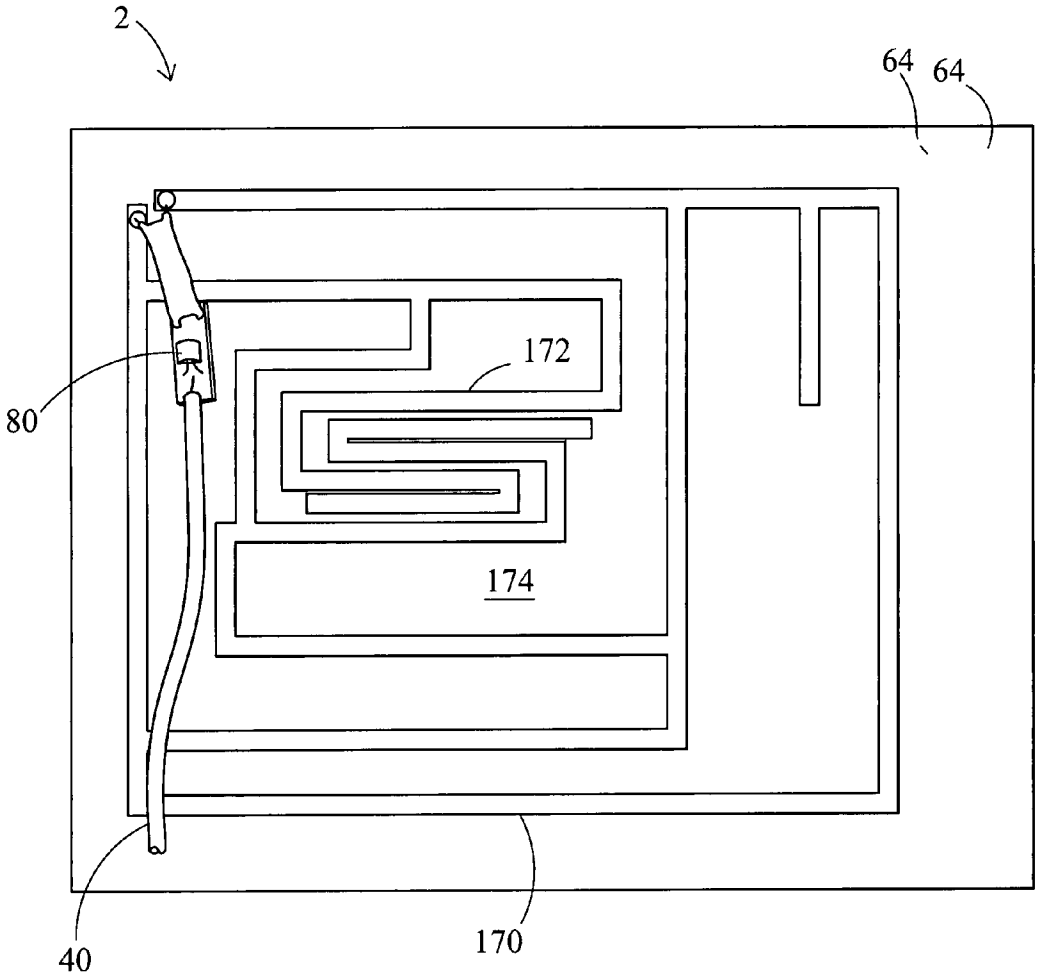
FIG. 34 is a front view of the signal receiving antenna of the present invention shown in FIG. 33 in an unrolled form and prior to its insertion into the vase antenna housing of the present invention.
Figure 35:
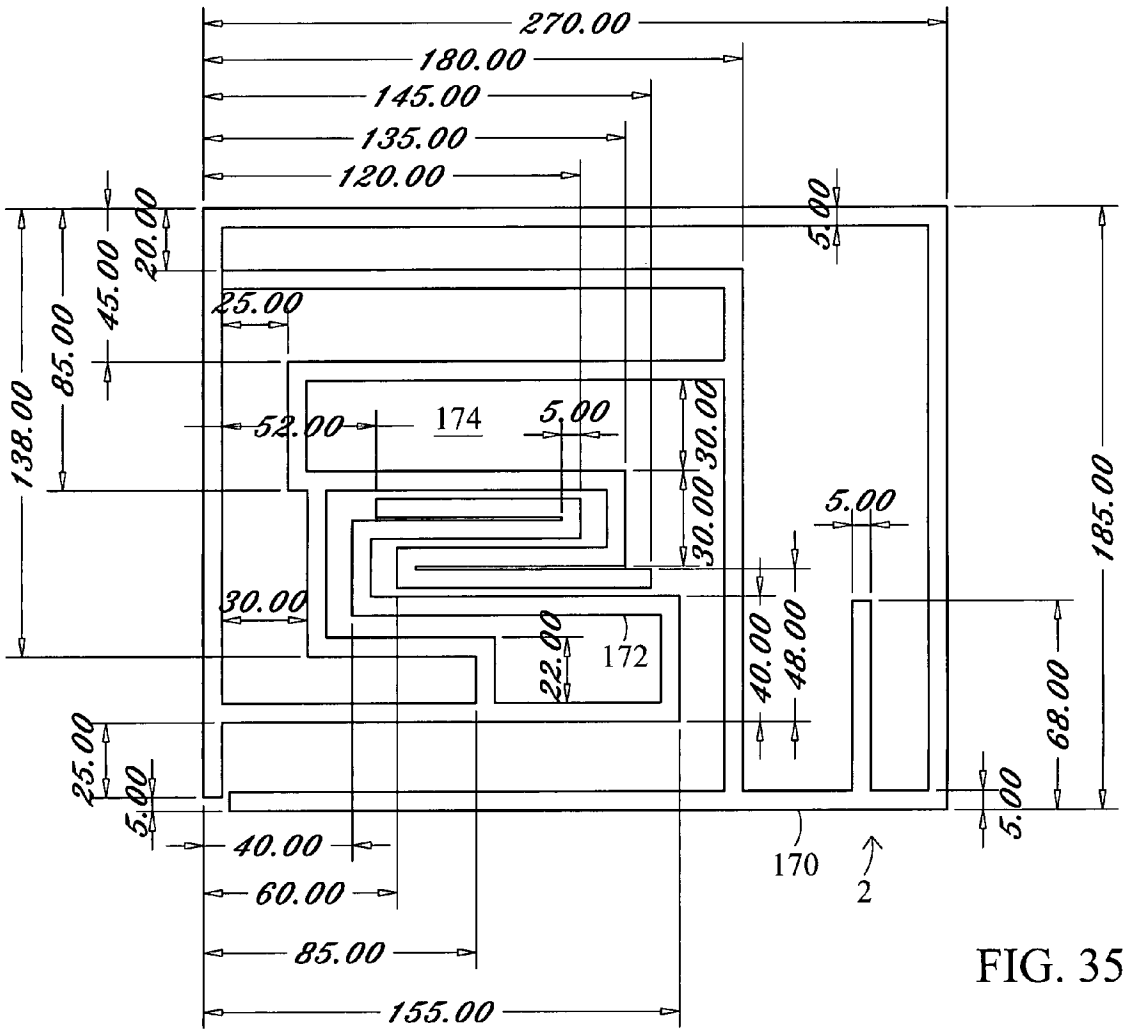
FIG. 35 is a front view of the signal receiving antenna of the present invention shown in FIG. 34 with preferred dimensions of the elements and segments of the antenna being shown.
Figure 38A:
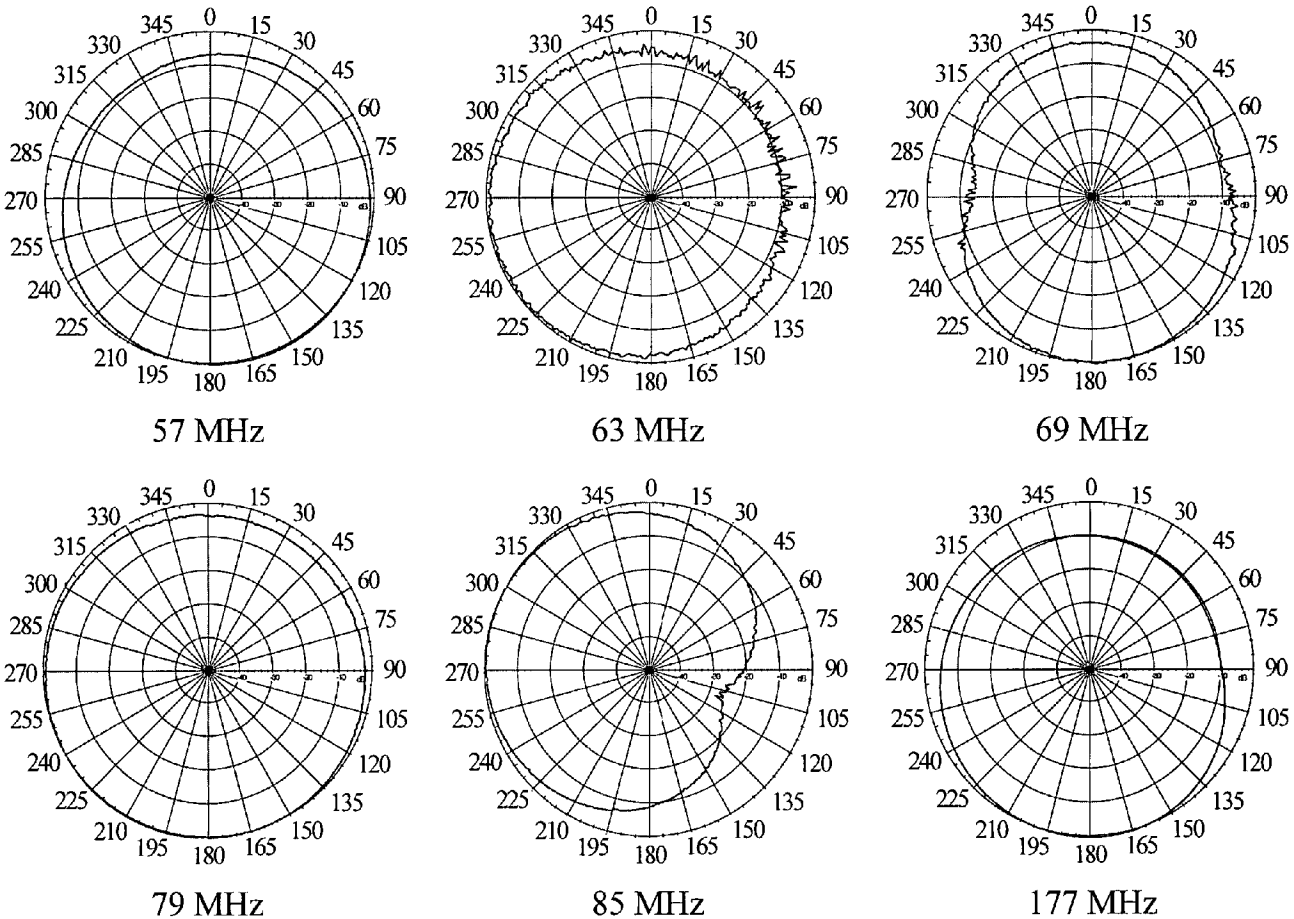
FIGS. 38A and 38B are a series of radiation patterns at vertical measured at certain frequencies (in MHz) in the VHF band for the signal receiving antenna shown in FIGS. 34 and 35, situated within the hourglass-shaped vase antenna housing, as shown in FIGS. 23-26, and formed in accordance with the present invention.
Figure 38B:
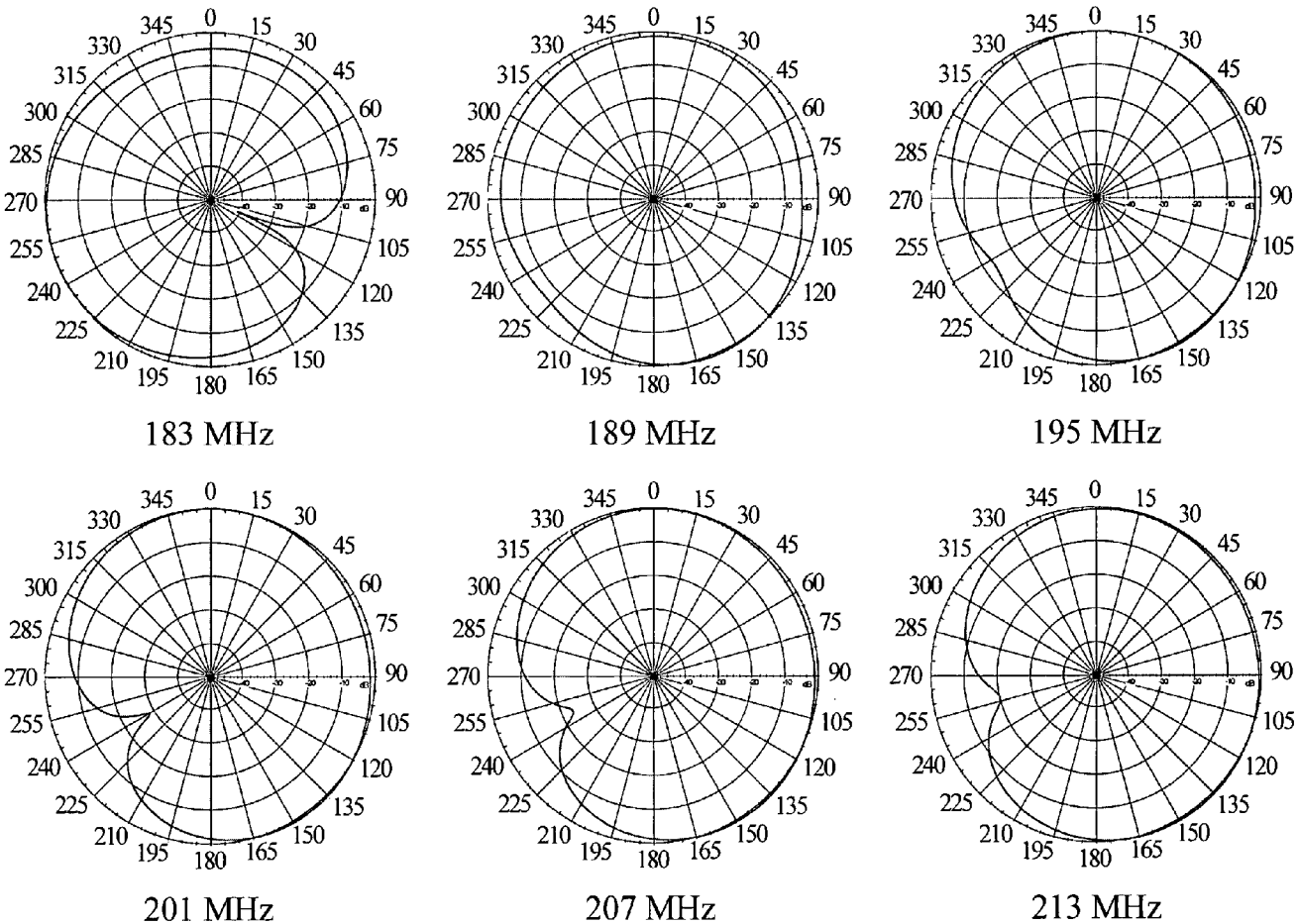
Figure 39A:
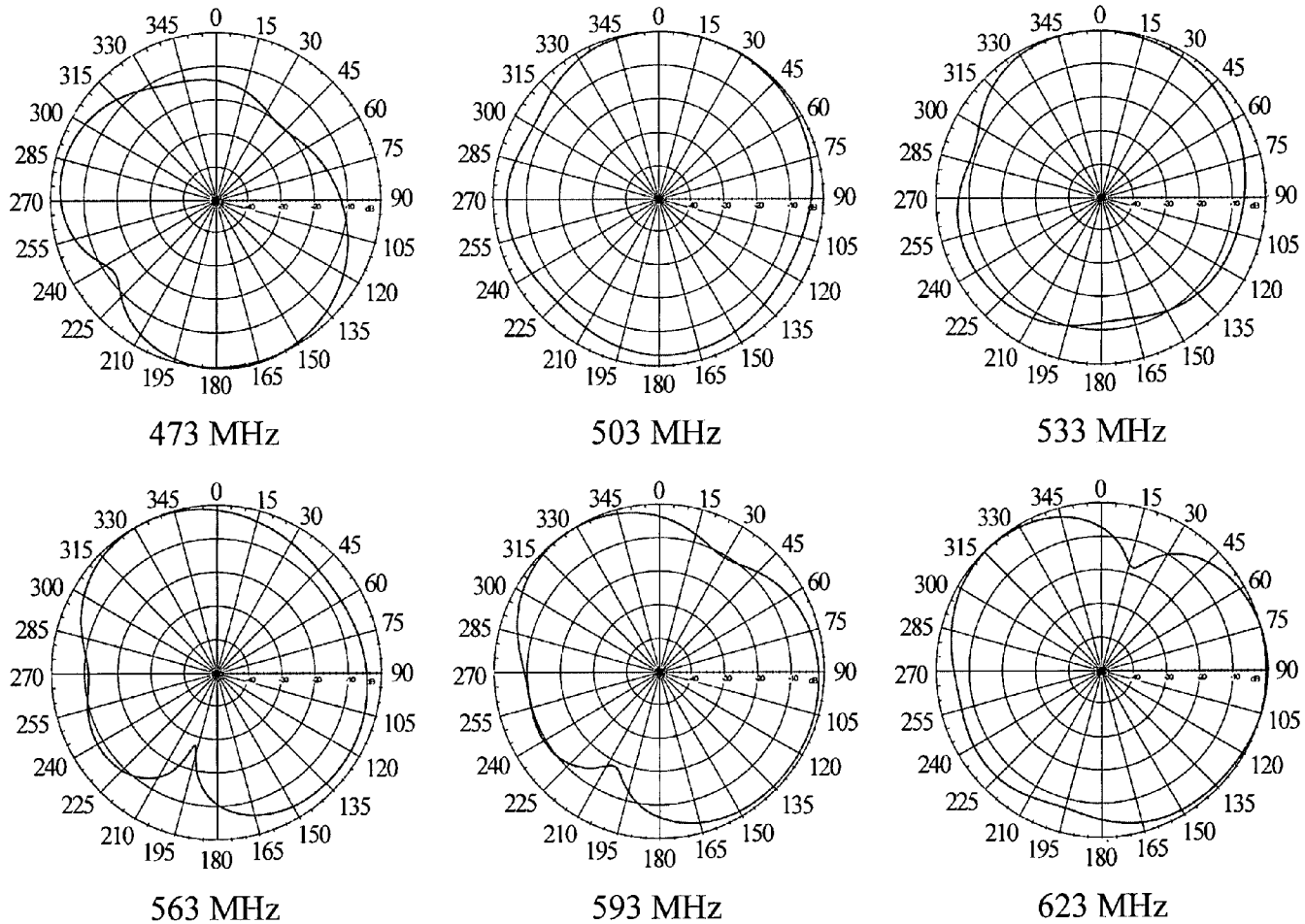
FIGS. 39A and 39B are a series of radiation patterns at vertical measured at certain frequencies (in MHz) in the UHF band for the signal receiving antenna shown in FIGS. 34 and 35, situated within the hourglass-shaped vase antenna housing, as shown in FIGS. 23-26, and formed in accordance with the present invention.
Figure 39B:
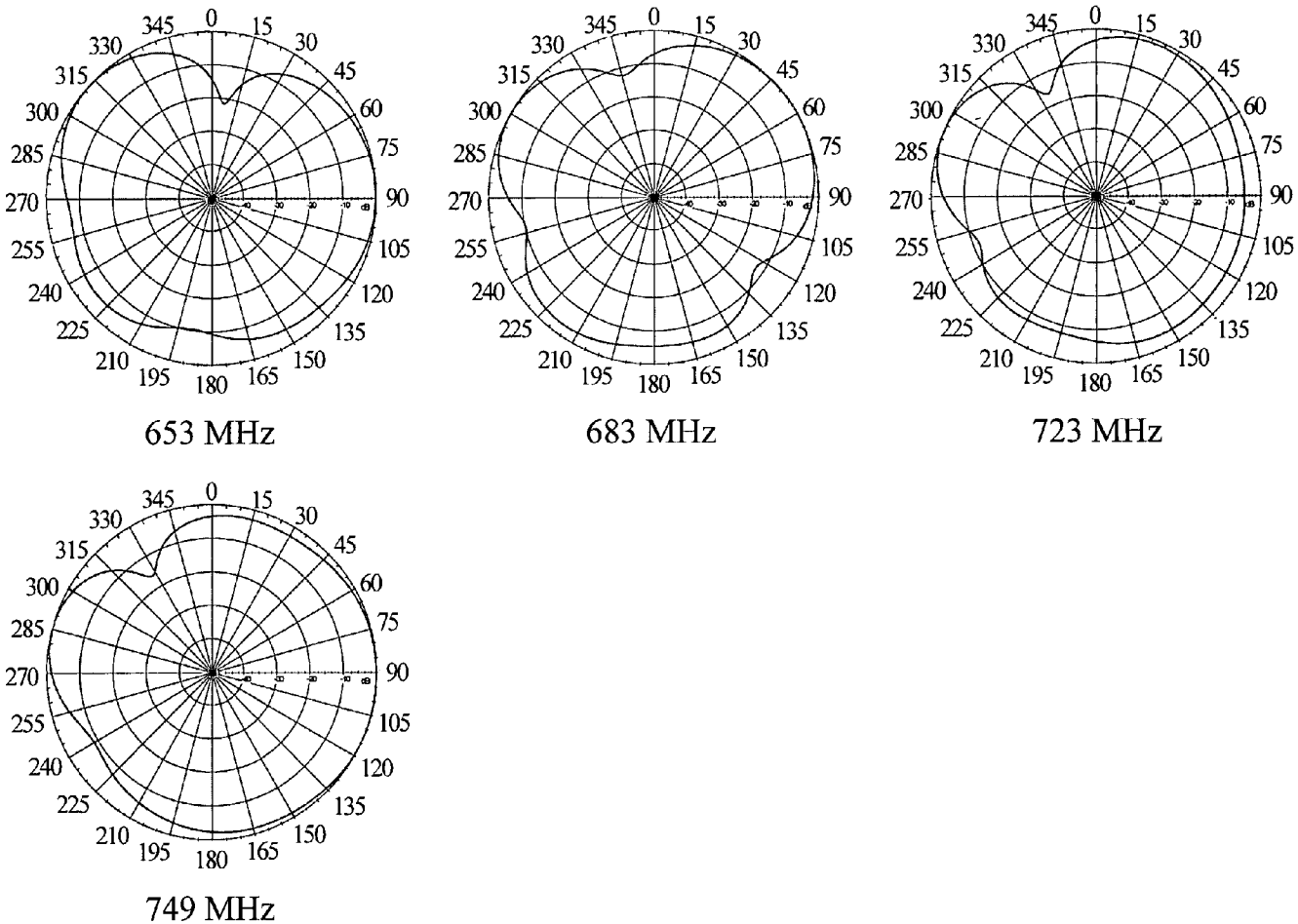

As mentioned previously, another preferred form of a signal receiving antenna 2 is shown in FIGS. 33-35. Again, this particular signal receiving antenna is preferably formed from a flexible electrically conductive material (or conductive paint) and is mounted to, or between, one or two sheets 64 of Mylar™ or other material, such as described previously with respect to the VHF and UHF bowtie antennas 66, 68 shown in FIGS. 26-28, which is wrapped about and secured to the cylindrical tube 56 as described previously, as shown in FIG. 33. The antenna 2 basically consists of a VHF component 170 and a UHF component 172, each being formed of antenna elements or segments, to receive digital broadcast television signals residing in the VHF and UHF bands. The VHF component 170 is generally in the form of a loop antenna, and the UHF component 172 is generally in the form of a folded dipole antenna whose antenna elements are interleaved with one another, the dipole antenna being situated within the interior area 174 defined by the outer VHF antenna 170. The preferred dimensions and angles of the various segments of the UHF and VHF antennas 170, 172 are shown in FIG. 35. The gain, omni-direction angles and radiation patterns at selected frequencies for the above-described receiving antenna are shown in FIGS. 36-39B.

For the signal receiving antenna shown in FIGS. 33-35, the coaxial cable's ground shield and signal conductor are connected to respective inputs of a 75-to-300 ohm balun transformer 80, the outputs of the transformer 80 being connected to spaced apart ends of the VHF loop antenna 170, as shown in FIG. 34. The elements of the UHF dipole antenna 172 are electrically coupled to the VHF loop antenna 170 by transmission lines at various points along the length of the VHF loop antenna 170 to provide good coupling characteristics between the VHF and UHF antennas, without the need for discrete coupling inductors or capacitors.

Although the vase antenna of the present invention has been heretofore described as having an hourglass-shaped housing 8, it should be realized that the housing may take on other vase shapes, such as cylindrical, or a generally truncated conical shape with a widened top end, for example. The various signal receiving antennas 2 described herein may be wrapped about a form, such as the cylindrical tube 56, which is received within the vase housing, or may be painted or etched on the outer surface or inner surface of the vase housing, as described previously.

Although illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. A television broadcast signal receiving antenna structure, which comprises:

a vase antenna housing, the vase antenna housing having a generally hourglass shape and including a generally conically-shaped lower segment, a generally conically-shaped upper segment mounted on and joined to the generally conically-shaped lower segment, each of the upper segment and lower segment having relatively larger and smaller diameter portions, the relatively smaller diameter portions of the upper and lower segments being joined together to define the generally hourglass-shaped vase antenna housing with one of a centered and off-centered relatively narrower diameter middle portion, the generally hourglass-shaped vase antenna housing having at least one of an inner surface and an outer surface extending in a longitudinal direction; and a signal receiving antenna, the signal receiving antenna being situated on the at least one of the inner surface and the outer surface of the vase antenna housing and thereby conforming to the shape thereof to exhibit an arcuate, partial hourglass shape.

2. A television broadcast signal receiving antenna structure as defined by claim 1, wherein the signal receiving antenna has a feedpoint, and wherein the feedpoint is longitudinally in alignment with the relatively narrower diameter middle portion of the vase antenna housing.

3. A television broadcast signal receiving antenna structure as defined by claim 1, wherein the signal receiving antenna is configured as a cloverleaf antenna formed of two overlapping bowtie antennas, each bowtie antenna having a center, the center of each bowtie antenna being situated in proximity to the relatively narrower diameter middle portion of the vase antenna housing, each bowtie antenna having a pair of bow antenna elements, one bow antenna element of each bowtie antenna being disposed longitudinally above the relatively narrower diameter middle portion of the vase antenna housing, and the other bow antenna element of each bowtie antenna being disposed longitudinally below the relatively narrower diameter middle portion of the vase antenna housing.

4. A television broadcast signal receiving antenna structure as defined by claim 3, wherein each bow antenna segment of each bowtie antenna includes a main portion and an extension portion, the extension portion being separated from the main portion by a slot.

5. A television broadcast signal receiving antenna structure as defined by claim 3, wherein each bow antenna segment of each bowtie antenna is formed generally in the shape of an equilateral triangle.

6. A television broadcast signal receiving antenna structure as defined by claim 1, wherein the signal receiving antenna is configured as a spiral antenna, the spiral antenna having a center, the center being situated in proximity to the relatively narrower diameter middle portion of the vase antenna housing.

7. A television broadcast signal receiving antenna structure as defined by claim 1, wherein the generally conically-shaped upper segment of the vase antenna housing is smaller in length measured along the longitudinal axis of the housing than the length of the conically-shaped lower segment of the vase antenna housing measured along the longitudinal axis of the housing.

8. A television broadcast signal receiving antenna structure as defined by claim 1, wherein the signal receiving antenna is formed as a metallic paint painted or etched on at least one of the inner surface and the outer surface of the vase antenna housing.

9. A television broadcast signal receiving antenna structure as defined by claim 1, wherein the signal receiving antenna is formed from a flexible sheet of electrically conductive material which is mounted on at least one of the inner surface and the outer surface of the vase antenna housing.

* * * * *